US008740335B2

(12) United States Patent
Mihara

(10) Patent No.: US 8,740,335 B2
(45) Date of Patent: Jun. 3, 2014

(54) IMAGE FORMING APPARATUS, IMAGE FORMING METHOD, AND COMPUTER-READABLE STORAGE MEDIUM

(71) Applicant: Yasumasa Mihara, Kanagawa (JP)

(72) Inventor: Yasumasa Mihara, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/790,851

(22) Filed: Mar. 8, 2013

(65) Prior Publication Data

US 2013/0249988 A1 Sep. 26, 2013

(30) Foreign Application Priority Data

Mar. 21, 2012 (JP) ..... 2012-063683

(51) Int. Cl.
*B41J 2/045* (2006.01)

(52) U.S. Cl.
USPC ..... 347/14; 347/19; 347/85

(58) Field of Classification Search
CPC ..... B41J 2002/17589; B41J 2002/17566; B41J 2/17556; B41J 2/04501
USPC ..... 347/7, 14, 19, 84–86
See application file for complete search history.

(56) References Cited

U.S. PATENT DOCUMENTS 8,366,249 B2 * 2/2013 Umeda ..... 347/85
2007/0024682 A1 * 2/2007 Inoue ..... 347/85
2011/0063344 A1 3/2011 Satoh et al.

FOREIGN PATENT DOCUMENTS

JP 2011-079292 4/2011

* cited by examiner

*Primary Examiner* — Thinh Nguyen
(74) *Attorney, Agent, or Firm* — Oblon, Spivak, McClelland, Maier & Neustadt, L.L.P.

(57) ABSTRACT

An image forming apparatus includes a print head configured to fire ink droplets; a subtank configured to store therein ink and supply the ink to the print head; a subatmospheric pressure generating unit configured to generate subatmospheric pressure in the subtank; a main tank configured to supply ink to the subtank; a detecting unit configured to detect an amount of ink in the main tank; and a control unit configured to control the subatmospheric pressure generating unit to generate subatmospheric pressure in the subtank and control the print head to fire ink droplets when the detecting unit detects that an amount of ink in the main tank is less than a predetermined first threshold, and control the print head to stop firing ink droplets when a time elapsed after the subatmospheric pressure is generated in the subtank exceeds a predetermined second threshold.

6 Claims, 16 Drawing Sheets

IMAGE FORMING APPARATUS, IMAGE FORMING METHOD, AND COMPUTER-READABLE STORAGE MEDIUM

CROSS-REFERENCE TO RELATED APPLICATION

The present application claims priority to and incorporates by reference the entire contents of Japanese Patent Application No. 2012-063683 filed in Japan on Mar. 21, 2012.

BACKGROUND OF THE INVENTION

1. Field of the Invention

The present invention relates to an image forming apparatus, an image forming method, and a computer-readable storage medium.

2. Description of the Related Art

Image forming apparatuses that form an image by firing ink droplets have been known. In such an image forming apparatus, when an ink cartridge is installed directly on top of a print head that fires ink droplets, the weight of the ink cartridge might obstruct a carriage holding the print head from carrying the print head in a scanning operation, and might cause image quality deterioration. In response to this issue, Japanese Patent Application Laid-open No. 2011-079292 discloses an image forming apparatus in which an ink cartridge is installed on the main unit of an image forming apparatus, and a subtank for temporarily storing ink is installed on the carriage.

Japanese Patent Application Laid-open No. 2011-079292 discloses supplying ink from an ink cartridge to a print head via a subtank. Furthermore, Japanese Patent Application Laid-open No. 2011-079292 discloses performing image formation using ink remaining in a subtank when the ink in an ink cartridge reaches an end state.

In these conventional technologies, if the ink cartridge is kept unused for a long time while the amount of remaining ink is low, nozzles being outlets for firing ink droplets, or the like could be clogged with ink.

Therefore, there is a need to provide an image forming apparatus, an image forming method, and a computer-readable storage medium that can suppress deterioration of the image quality caused by ink clogging even when the amount of ink remaining in an ink cartridge is low.

SUMMARY OF THE INVENTION

It is an object of the present invention to at least partially solve the problems in the conventional technology.

According to an embodiment, there is provided an image forming apparatus that includes a print head configured to fire ink droplets; a subtank configured to store therein ink and supply the ink to the print head; a subatmospheric pressure generating unit configured to generate subatmospheric pressure in the subtank; a main tank configured to supply ink to the subtank; a detecting unit configured to detect an amount of ink in the main tank; and a control unit configured to control the subatmospheric pressure generating unit to generate subatmospheric pressure in the subtank and control the print head to fire ink droplets when the detecting unit detects that an amount of ink in the main tank is less than a predetermined first threshold, and control the print head to stop firing ink droplets when a time elapsed after the subatmospheric pressure is generated in the subtank exceeds a predetermined second threshold.

According to another embodiment, there is provided an image forming method performed in an image forming apparatus that includes a print head configured to fire ink droplets, a subtank configured to store therein ink and supply the ink to the print head, a subatmospheric pressure generating unit configured to generate subatmospheric pressure in the subtank, and a main tank configured to supply ink to the subtank. The image forming method includes detecting an amount of ink in the main tank; controlling the subatmospheric pressure generating unit to generate subatmospheric pressure in the subtank and to cause the print head to fire ink droplets when an amount of ink in the main tank is detected to be less than a predetermined first threshold; and controlling the print head to stop firing ink droplets when a time elapsed after the subatmospheric pressure is generated in the subtank exceeds a predetermined second threshold.

According to still another embodiment, there is provided a non-transitory computer-readable storage medium with an executable program stored thereon and executed by a processor of an image forming apparatus that includes a print head configured to fire ink droplets, a subtank configured to store therein ink and supply the ink to the print head, a subatmospheric pressure generating unit configured to generate subatmospheric pressure in the subtank, and a main tank configured to supply ink to the subtank. The program instructs the processor to execute detecting an amount of ink in the main tank; controlling the subatmospheric pressure generating unit to generate subatmospheric pressure in the subtank and to cause the print head to fire ink droplets when an amount of ink in the main tank is detected to be less than a predetermined first threshold; and controlling the print head to stop firing ink droplets when a time elapsed after the subatmospheric pressure is generated in the subtank exceeds a predetermined second threshold.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of an image forming apparatus will now be explained with reference to the appended drawings.

Figure 1:
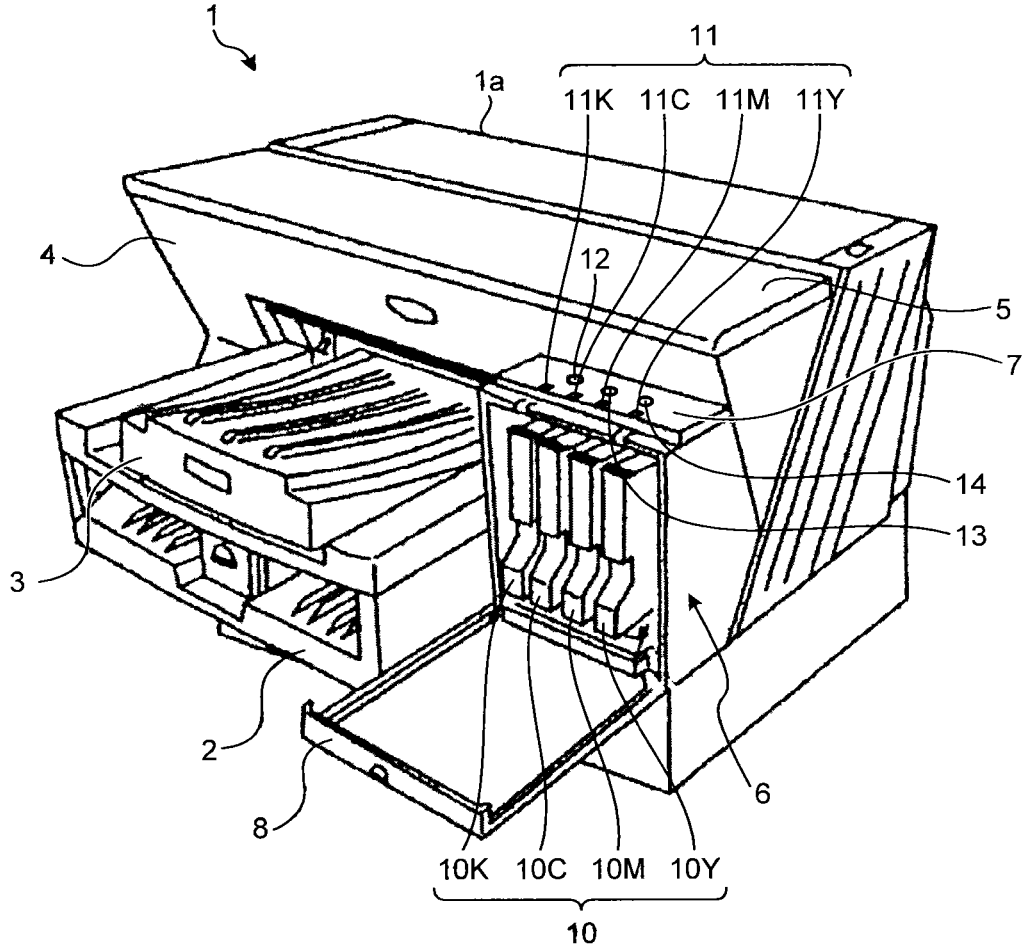
FIG. 1 is a perspective view illustrating an image forming apparatus according to an embodiment of the present invention.

FIG. 1 is a perspective view illustrating an image forming apparatus 1 according to the embodiment. As illustrated in FIG. 1, the image forming apparatus 1 according to the embodiment includes an apparatus main unit 1*a*, a paper feed tray 2, and a discharge tray 3. The paper feed tray 2 is a tray from which sheets being recording media are fed into the apparatus main unit 1*a*. The discharge tray 3 retains sheets having formed with images.

Provided on one end of a front surface 4 of the apparatus main unit 1*a* is a cartridge housing 6 that protrudes from the front surface 4 toward the front side, and positioned at a lower level than a top surface 5. An ink cartridge 10 (main tank) is installed in the cartridge housing 6. Provided on the front side of the cartridge housing 6 is a front cover 8 enabled to be opened and closed.

The ink cartridge 10 is filled with ink to be supplied to a print head to be described later. In the embodiment, the ink cartridge 10 includes an ink cartridge 10K, an ink cartridge 10C, an ink cartridge 10M, and an ink cartridge 10Y storing therein ink in colors of black (K), cyan (C), magenta (M), and yellow (Y), respectively. The ink cartridges 10 are installed removably on the apparatus main unit 1*a*.

Provided on the top surface of the cartridge housing 6 is an operation display unit 7. The operation display unit 7 receives various instructions from a user, and displays various types of information.

In the embodiment, the operation display unit 7 includes remaining ink indicators 11. The remaining ink indicators 11 indicate the amount of ink remaining in the ink cartridges 10 of the respective colors (the ink cartridge 10K, the ink cartridge 100, the ink cartridge 10M, and the ink cartridge 10Y). In the embodiment, the remaining ink indicator 11 includes a remaining ink indicator 11K, a remaining ink indicator 11C, a remaining ink indicator 11M, and a remaining ink indicator 11Y each of which displays the amount of ink remaining in the corresponding cartridge 10 of the corresponding color (the ink cartridge 10K, the ink cartridge 100, the ink cartridge 10M, and the ink cartridge 10Y). In the operation display unit 7, the remaining ink indicator 11K, the remaining ink indicator 11C, the remaining ink indicator 11M, and the remaining ink indicator 11Y are provided at positions corresponding to the positions where the ink cartridge 10K, the ink cartridge 100, the ink cartridge 10M, and the ink cartridge 10Y are installed, respectively.

The operation display unit 7 also includes a power button 12, a continue image formation button 13, and a cancel button 14. The operation display unit 7 also includes input buttons not illustrated for entering various instructions including various character information and numeric information. The power button 12 receives an instruction of an operation from a user when power is to be supplied to the image forming apparatus 1 and when the power supply to the image forming apparatus 1 is to be stopped. In the embodiment, when a user gives an instruction for continuing image formation to the image forming apparatus 1 even if the amount of ink remaining in the ink cartridge 10 is less than a first threshold (which will be explained in detail later), the instruction of the operation is received on the continue image formation button 13 from the user. The cancel button 14 receives an instruction of an operation from a user when the user is to cancel various operation inputs.

Figure 2:
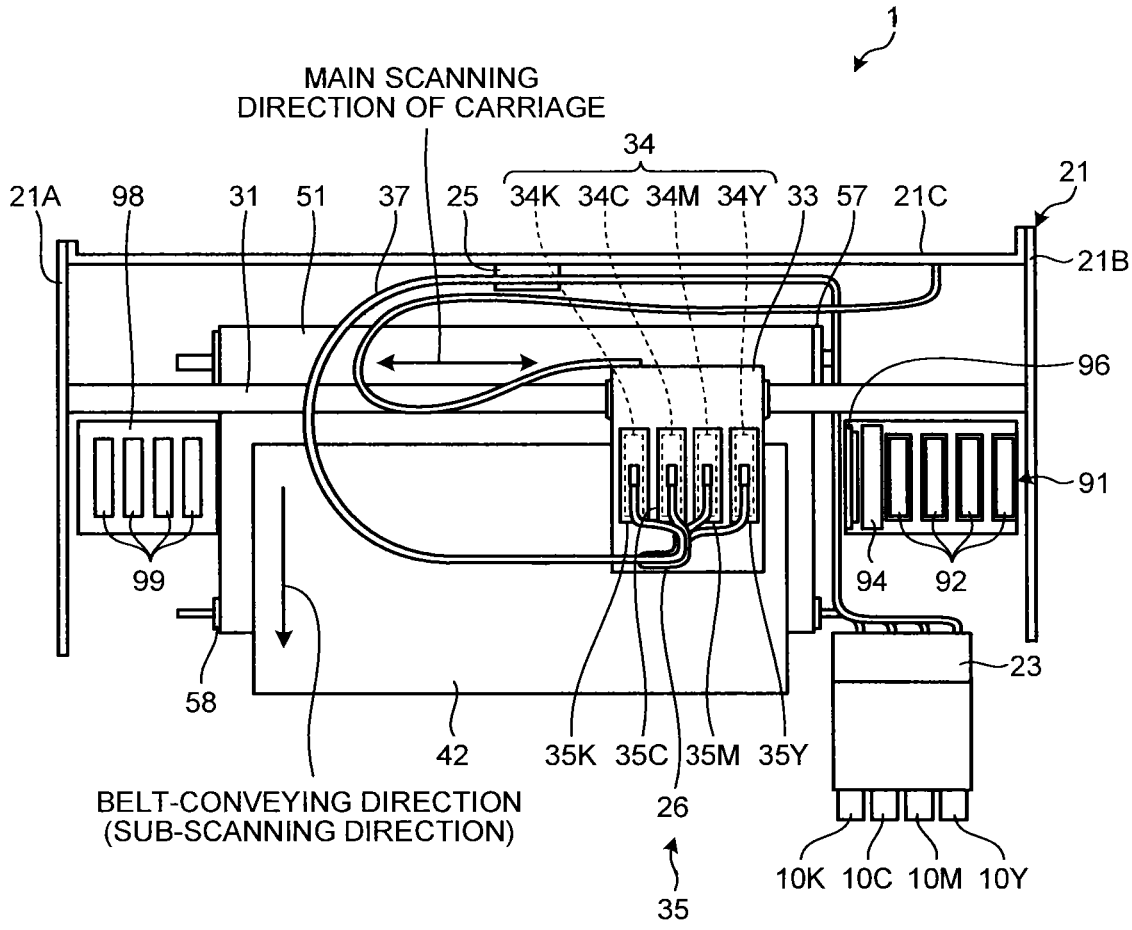
FIG. 2 is a plan view illustrating a relevant portion of the image forming apparatus.

FIG. 2 is a plan view illustrating a relevant portion of the image forming apparatus 1.

As illustrated in FIG. 2, a guide rod 31 is provided to the image forming apparatus 1. The guide rod 31 extends laterally between a left plate 21A and a right plate 21B included in a frame 21. The guide rod 31 functions as a guiding member when a carriage 33 is moved in a scanning operation in a main-scanning direction. The guide rod 31 supports the carriage 33 slidably in the main-scanning direction. A main scanning motor (not illustrated) moves the carriage 33 in a scanning operation along the guide rod 31 in a direction indicated by an arrow in FIG. 2 (carriage scanning direction: main-scanning direction).

Print heads 34 for firing ink droplets are provided to the carriage 33. In other words, the carriage 33 moves the print heads 34 in a scanning operation in the main-scanning direction. Ink droplets are fired from the print heads 34. Each print head used as the print heads 34 includes a mechanism for generating a pressure for causing ink droplets to be fired. Examples of such a mechanism include piezoelectric actuators such as a piezoelectric element, a thermal actuator that uses a phase transition of a liquid caused by film boiling achieved by using thermoelectric converting elements such as a heating element, a shape memory alloy actuator using a phase transition of the metal caused by a temperature change, and an electrostatic actuator that uses an electrostatic force.

In the embodiment, the print heads 34 include a print head 34Y firing yellow (Y) ink droplets, a print head 34C firing cyan (C) ink droplets, a print head 34M firing magenta (M) ink droplets, and a print head 34K firing black (K) ink droplet. The print head 34C, the print head 34M, the print head 34Y, and the print head 34K are arranged along the main-scanning direction. The print head 34C, the print head 34M, the print head 34Y, and the print head 34K are referred to as a print head 34 when these print heads are generally explained.

Explained in the embodiment is a configuration in which the print heads 34 include print heads 34 that fire ink droplets in four colors (the print head 34C, the print head 34M, the print head 34Y, and the print head 34K), respectively, but the color may be one or more, without limitation to the four colors.

In the carriage 33, subtanks 35 are installed. The ink supplied from the ink cartridges 10, which are main tanks, is stored in the respective subtanks 35, and the ink is supplied to the print heads 34 from the respective subtanks 35. The subtanks 35 are provided correspondingly to the print heads 34 which correspond to the respective colors, and supply ink to the respective print heads 34 corresponding to the respective colors. In the embodiment, the subtanks 35 include a subtank 35C supplying ink to the print head 34C, a subtank 35M supplying ink to the print head 34M, a subtank 35Y supplying ink to the print head 34Y, and a subtank 35K supplying ink to the print head 34K.

The subtank 35C, the subtank 35M, the subtank 35Y, and the subtank 35K are referred to as the subtank 35 when these subtanks are generally explained.

To each of the subtanks 35 (the subtank 35C, the subtank 35M, the subtank 35Y, and the subtank 35K), ink in the corresponding color is supplied from the corresponding ink cartridge 10 (the ink cartridge 10C, the ink cartridge 10M, the ink cartridge 10Y, or the ink cartridge 10K) via an ink supplying tube 37.

A supplying pump unit 23 for carrying the ink stored in the ink cartridge 10 to the subtank 35 is provided to the apparatus main unit 1*a*. A main unit side holder 25 holds a part of the outer circumferential surface of the ink supplying tube 37 against a rear plate 21C included in the frame 21. One end of the outer circumferential surface of the ink supplying tube 37 near the subtank 35 is fixed to a fixing rib 26 on the carriage 33.

A maintaining and recovering mechanism (servicing station) 91 for maintaining and recovering the condition of nozzles on the print heads 34 is positioned in a non-print zone on one side of the scanning direction of the carriage 33. The maintaining and recovering mechanism 91 includes a cap member 92, a wiper member 96, and a spittoon 94. The cap member 92 caps nozzle surfaces on the print heads 34. The wiper member 96 wipes nozzle outlets from which ink liquid is fired (sometimes referred to as nozzle surfaces) on the print heads 34. The spittoon 94 receives ink droplets when ink droplets not contributing to image formation are spitted so as to discharge ink having increased in viscosity. A waste ink tank (not illustrated) for storing therein waste ink resulting from the maintaining and recovering operation is installed replaceably in the apparatus main unit under the maintaining and recovering mechanism 91.

A spittoon 99 is positioned in a non-print zone on other side of the scanning direction of the carriage 33. The spittoon 99 has an opening 98 extending along a direction of a nozzle array on the print heads 34. The spittoon 99 receives ink droplets during ink spitting that is an operation in which ink droplets not contributing to image formation are spitted so as to discharge the ink liquid having increased in viscosity during image formation, for example.

Figure 3:
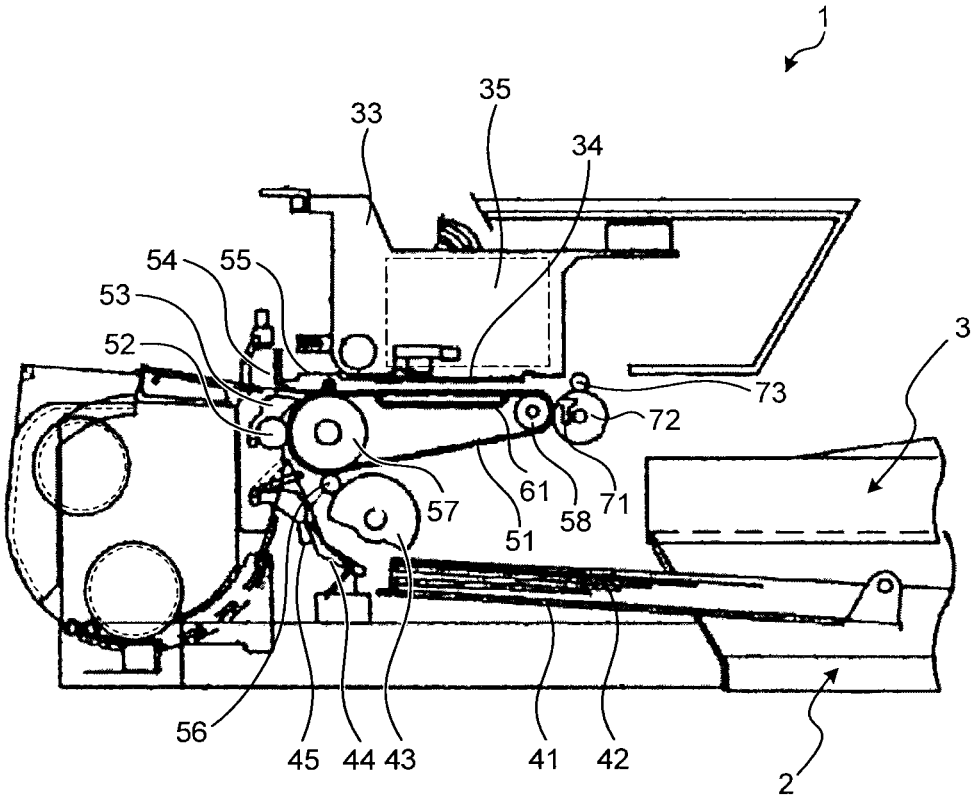
FIG. 3 is a schematic illustrating a sectional view of the image forming apparatus.

FIG. 3 is a schematic illustrating a sectional view of the image forming apparatus 1.

As illustrated in FIG. 3, provided to the paper feed tray 2 in the image forming apparatus 1 is a sheet stacker (pressurizing plate) 41 on which sheets 42 are stacked. The sheets 42 stacked on the sheet stacker 41 are separated and conveyed from the sheet stacker 41 one sheet at a time, by semicircular/paper-feeding rollers 43, and a separation pad 44. The separation pad 44 is made of a material having a larger friction coefficient than that of the semicircular/paper-feeding rollers 43.

On the downstream side of the sheet stacker 41 in the conveying direction of the sheet 42, a guiding member 45, a holding member 54, and a carriage belt 51 are provided. The carriage belt 51 is an endless belt, and is stretched across a conveying roller 57 and a tension roller 58. The carriage belt 51 is rotated by driving rotations of the conveying roller 57 and the tension roller 58 in a belt conveying direction (sub-scanning direction). A roller charging device 56 for charging the surface of the carriage belt 51 is provided on the outer circumferential surface of the carriage belt 51. The roller charging device 56 charges the outer circumferential surface of the carriage belt 51.

A guiding member 61 is provided across a zone facing the print heads 34 on the inner circumferential side of the carriage belt 51. A top surface of the guiding member 61 protrudes toward the print heads 34 from a tangent line of the two rollers (the conveying roller 57 and the tension roller 58) supporting the carriage belt 51. In this arrangement, because the carriage belt 51 is guided across the print zone while being pressed by the top surface of the guiding member 61, the flatness of the carriage belt 51 is maintained highly precisely.

The sheet 42 carried from the sheet stacker 41 is carried along the guiding member 45, and reaches the carriage belt 51. The sheet 42 is carried by the carriage belt 51 in a manner retained on the outer circumferential surface of the charged carriage belt 51, and reaches the area where the ink droplets are fired from the print heads 34. The ink droplets are fired from the print heads 34 onto the sheet 42, whereby forming an image on the sheet 42.

On the downstream side of the zone where the print heads 34 fire ink droplets onto the sheet 42 in the conveying direction of the sheet 42, a separating claw 71, a discharging roller 72, a sheet pinch roller 73, and the discharge tray 3 are provided. The separating claw 71 separates the sheet 42 having formed with an image with the ink droplets fired from the print heads 34 from the carriage belt 51, and the discharging roller 72 and the sheet pinch roller 73 discharge the sheet 42 onto the discharge tray 3.

In the image forming apparatus 1 having such a structure, the sheet 42 is separated and fed from the paper feed tray 2 one sheet at a time. The sheet 42 is then conveyed along the guiding member 45, and reaches the position of the carriage belt 51. The sheet 42 is then carried in a manner nipped between the carriage belt 51 and a counter roller 52, and the leading end of the sheet 42 in the conveying direction is guided by a conveying guide 53. A leading-end pressing roller 55 then presses the sheet 42 against the carriage belt 51, whereby turning the direction in which the sheet 42 is conveyed by approximately 90 degrees.

The roller charging device 56 charges the outer circumferential surface of the carriage belt 51. In the embodiment, because the outer circumferential surface of the carriage belt 51 is charged by the roller charging device 56 that is applied with an alternating voltage, the outer circumferential surface is charged to a positive charge and a negative charge alternatingly, like bands each having a given width in the sub-scanning direction. Because the sheet 42 is fed to the carriage belt 51 charged alternatingly to a positive charge and a negative charge, the sheet 42 is sucked onto the outer circumference of the carriage belt 51, and carried by the carriage belt 51 in the sub-scanning direction, and reaches the zone in which the print heads 34 fire ink droplets.

The carriage 33 carries the print heads 34 in the main-scanning direction. As the print heads 34 are carried in the main-scanning direction, the print heads 34 fire ink droplets to the sheet 42 along a direction corresponding to the main-scanning direction of the print heads 34. The carriage belt 51 carries the sheet 42 in the sub-scanning direction. Therefore, ink droplets are fired to the sheet 42 in the main-scanning direction as well as in the sub-scanning direction, whereby forming an image on the sheet 42.

The sheet 42 on which the image is formed is discharged to the discharge tray 3. During the time no image is formed on the sheet 42 by firing of ink droplets, in other words, during image formation standby time, the carriage 33 is moved near the maintaining and recovering mechanism 91. The print heads 34 supported by the carriage 33 are capped by the cap 92 so that the nozzles of the respective print heads 34 are kept moist. In this manner, firing of the print heads 34 is prevented from becoming defective because of the ink drying. A suction pump not illustrated is used to suck ink from the nozzles on each of the print heads 34 while the print heads 34 are capped by the cap 92 (sometimes referred to as "nozzle purging" or "head purging"). In this manner, the image forming apparatus 1 performs a recovering operation in which ink liquid having become more viscous or air bubbles in the print heads 34 are removed. In addition, the image forming apparatus 1 performs spitting, in which ink not contributing to image formation is spitted, before an image is formed or while an image is being formed.

Figure 4:
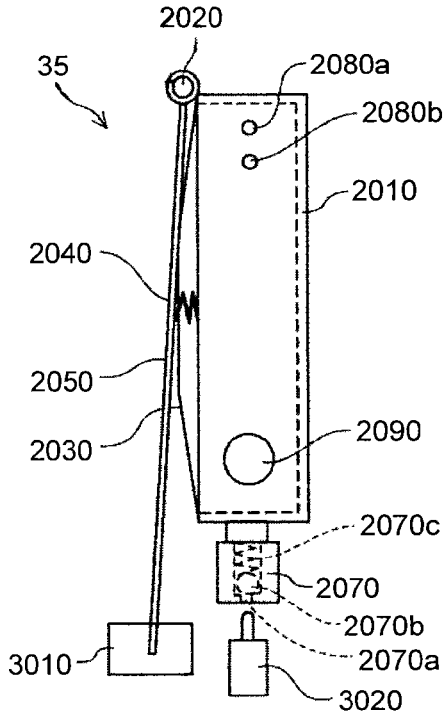
FIG. 4 is a top view of a subtank.
Figure 5:
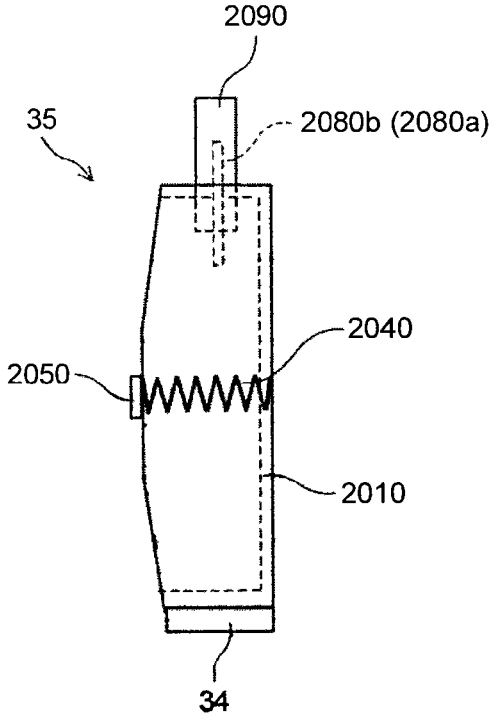
FIG. 5 is a front view of the subtank.

The subtank 35 will now be explained in detail. FIG. 4 is a top view of the subtank 35. FIG. 5 is a front view of the subtank 35.

The subtank 35 includes a tank case 2010. The tank case 2010 stores therein the ink supplied from the ink cartridge 10, and supplies the ink thus stored to the print head 34. An opening is provided to the tank case 2010. The opening on the tank case 2010 is sealed by a flexible film 2030. The flexible film 2030 is biased toward outside of the tank case 2010 by a spring 2040 disposed inside of the tank case 2010. Because the flexible film 2030 on the tank case 2010 is biased toward outside by the spring 2040, when the amount of ink remaining in the tank case 2010 decreases, subatmospheric pressure is generated inside of the tank case 2010.

A displaced member 2050 is provided outside of the tank case 2010. The displaced member 2050 is made of a feeler or the like and one end of the displaced member 2050 is supported swingably by a shaft 2020. The displaced member 2050 is biased against the tank case 2010. The displaced member 2050 is fixed, e.g., adhered, to the flexible film 2030, and is displaced as the flexible film 2030 moves. A second detecting unit 3010 detects the amount of ink remaining in the subtank 35. The second detecting unit 3010 includes an optical sensor, and detects the amount of ink remaining in the subtank 35 by detecting the amount by which the displaced member 2050 is displaced.

Provided on top of the tank case 2010 is a supply inlet 2090 through which the ink from the ink cartridge 10 is supplied. The tank case 2010 is communicatively connected to the ink cartridge 10 of the corresponding color via the supply inlet 2090 and the ink supplying tube 37.

An atmospheric release mechanism 2070 for releasing the air inside of the subtank 35 to the atmosphere is provided on a side surface of the tank case 2010. The atmospheric release mechanism 2070 includes an atmospheric release channel 2070*a* that is communicatively connected to the space inside of the subtank 35, a valve 2070*b* for opening and closing the atmospheric release channel 2070*a*, and a spring 2070*c* for biasing the valve 2070*b* at a closed position.

When a driving unit 3020 is driven to open the valve 2070*b* provided to the atmospheric release mechanism 2070, the air inside of the subtank 35 is released to the atmosphere (communicatively connected to the atmosphere). When the driving unit 3020 is driven to close the valve 2070*b* provided to the atmospheric release mechanism 2070, the subtanks 35 is sealed (not communicatively connected to the atmosphere). The driving unit 3020 is electrically connected to a control unit for controlling the image forming apparatus 1 (a control unit 200 which will be explained later in detail).

An electrode pin 2080*a* and an electrode pin 2080*b* are provided in the subtank 35. The electrode pin 2080*a* and the electrode pin 2080*b* detect the level of the surface of the liquid ink in the subtanks 35. In other words, when the ink stored in the subtank 35 reaches the level of the electrode pin 2080*a* and the electrode pin 2080*b*, an electric current flows between the electrode pin 2080*a* and the electrode pin 2080*b*, whereby changing the resistance. The electrode pin 2080*a* and the electrode pin 2080*b* detect the level of the surface of the liquid ink in the subtank 35, that is, the amount of the air in the subtank 35 based on the change in the resistance.

The electrode pin 2080*a* and the electrode pin 2080*b* function as a first detecting unit 70 for detecting the amount of ink remaining in the subtank 35.

In the embodiment, a subatmospheric pressure generating unit generates subatmospheric pressure (a pressure lower than the atmospheric pressure) inside of the subtank 35.

Figure 6:
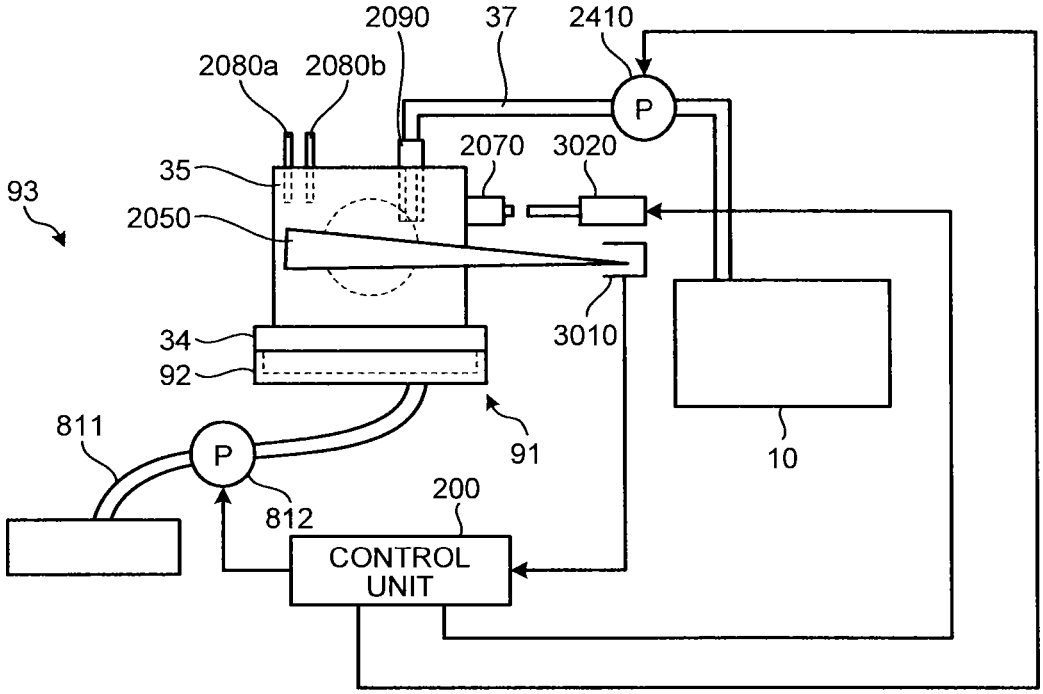
FIG. 6 is a schematic for explaining a subatmospheric pressure generating unit.

FIG. 6 is a schematic for explaining a mechanism functioning as a subatmospheric pressure generating unit 93 for generating subatmospheric pressure in the subtank 35.

A supplying pump 2410 supplies ink in the ink cartridge 10 to the subtank 35 via the ink supplying tube 37. The supplying pump 2410 is electrically connected to the control unit 200 controlling the image forming apparatus 1.

A suction pump 812 in the maintaining and recovering mechanism 91 is driven while the nozzle surfaces on the print heads 34 are capped with the cap member 92 in the maintaining and recovering mechanism 91 and while the atmospheric release mechanism 2070 in the subtank 35 is closed. As the suction pump 812 is driven, ink is suctioned through the nozzles being ink outlets on the print heads 34 via a suction tube 811. As the ink in the subtank 35 is suctioned, the spring 2040 is caused to press the flexible film 2030 toward outside of the subtank 35, and subatmospheric pressure is generated inside of the subtank 35.

Subatmospheric pressure can also be generated in the subtank 35 by causing the print heads 34 to spit ink droplets not contributing to image formation into the spittoon 94 (see FIG. 2) while the atmospheric release mechanism 2070 in the subtank 35 is closed. In other words, by discharging the ink droplets from the subtank 35 while the atmospheric release mechanism 2070 is closed, the spring 2040 is caused to press the flexible film 2030 toward outside of the subtank 35, and subatmospheric pressure is generated inside of the subtank 35.

In other words, the atmospheric release mechanism 2070, the print heads 34, the suction pump 812, the suction tube 811, the spring 2040, the flexible film 2030, and the like function as the subatmospheric pressure generating unit 93.

The pressure (subatmospheric pressure) in the subtank 35 is detected by a mechanism to be described below.

Figure 7:
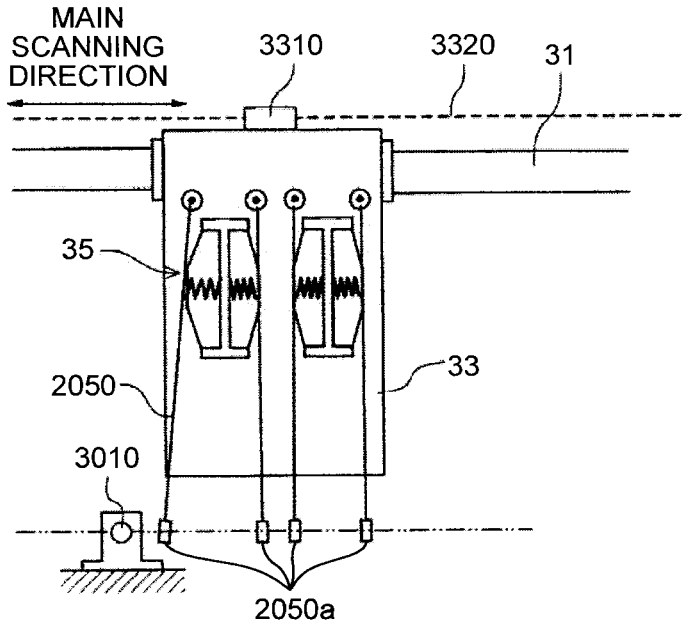
FIG. 7 is schematic for explaining a mechanism for detecting pressure in the subtank.
Figure 8:
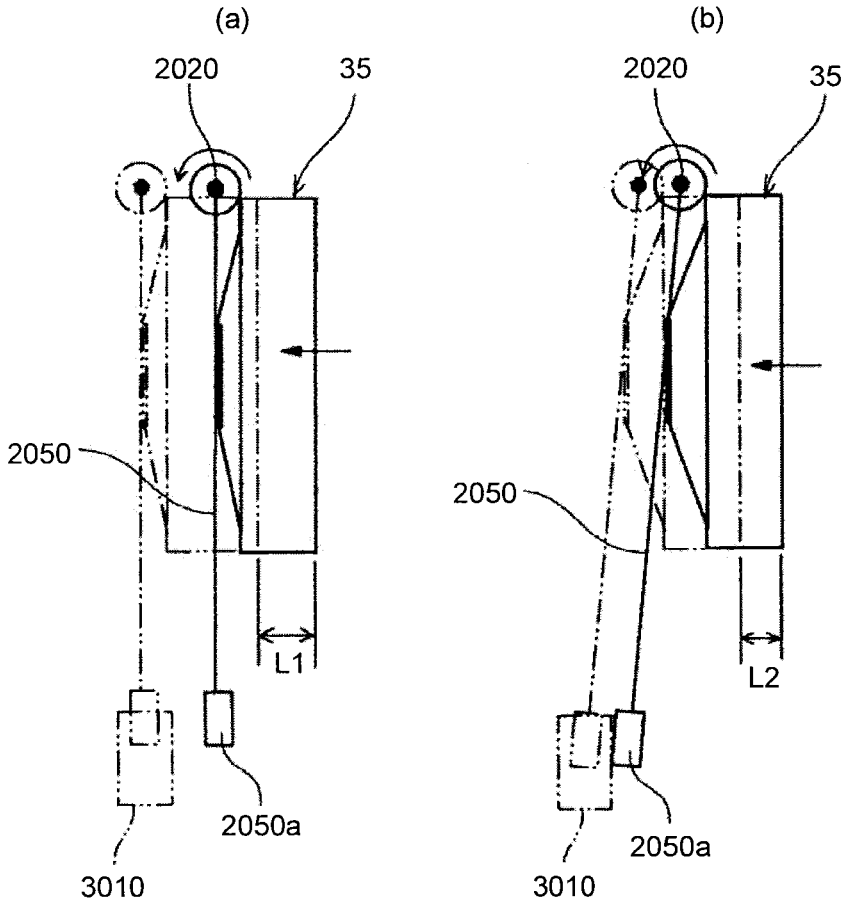
FIG. 8 illustrates a mechanism for detecting the pressure in the subtank in a different condition.

FIGS. 7 and 8 are schematics for explaining the mechanism for detecting the pressure in the subtank 35.

As illustrated in FIG. 7, the second detecting unit 3010 is installed on the apparatus main unit at a position where an end 2050*a* of the displaced member 2050 provided to each of the subtanks 35 passes when the carriage 33 is moved in the main-scanning direction. The position of the carriage 33 in the main-scanning direction is detected by allowing a linear encoder 3310 provided to the carriage 33 to read an encoder scale 3320 laid in the main-scanning direction of the guide rod 31.

While the subatmospheric pressure (pressure) in the subtank 35 is at a normal condition as illustrated in (a) of FIG. 8, when the subtank 35 is carried on the carriage 33 from a predetermined position illustrated by a solid line by a distance L1 in the direction of the arrow, the second detecting unit 3010 detects the end 2050*a* of the displaced member 2050.

By contrast, when the subatmospheric pressure (pressure) in the subtank 35 is at an abnormal condition as illustrated in (b) of FIG. 8, the displaced member 2050, which should be carried near the subtank 35, is carried away from the subtank 35 (the displaced member 2050 is pressed outwardly by the resilient force of the spring 2040). Therefore, as the carriage 33 moves from the predetermined position illustrated by the solid line in the direction of the arrow, the second detecting unit 3010 detects the displaced member 2050 at the point where the carriage 33 is moved by a distance L2 that is less than the distance L1 by which the carriage 33 is moved when the subatmospheric pressure in the subtank 35 is at a normal condition.

In this manner, by detecting the position of the subtank 35 (distance by which the subtank 35 is moved) at the time when the displaced member 2050 is detected, the second detecting unit 3010 can detect the amount by which the displaced member 2050 is displaced (corresponding to the amount by which the spring 2040 in the subtank 35 is displaced), the pressure in the subtank 35, and even the amount of ink remaining in the subtank 35.

At this time, during normal image formation of the image forming apparatus 1 according to the embodiment, ink supplied from the ink cartridge 10 to the subtank 35 is further supplied to the corresponding print head 34 from the subtank 35, and an ink droplets are fired from the nozzles that are ink outlets on the corresponding print head 34.

The amount of ink remaining in the ink cartridge 10 could become lower than the first threshold. The first threshold is a threshold at which it becomes difficult to supply the ink in the ink cartridge 10 to the subtank 35. In other words, when the amount of ink remaining in the ink cartridge 10 is less than the first threshold, a very small amount of ink is remaining or no ink is remaining in the ink cartridge 10.

In the embodiment, the condition in which the ink material in the ink cartridge 10 is less than the first threshold is referred to as an ink-end state of the main tank or an ink-end state of the ink cartridge 10. An ink-end is detected by the first detecting unit 70 and/or the second detecting unit 3010.

When the ink cartridge 10 reaches an ink-end state, in the embodiment, images are formed by firing ink droplets from the print heads 34 using only the ink remaining in the subtank 35 (in other words, using the ink stored in the subtank 35, instead of the ink supplied from the ink cartridge 10). Such image formation is sometimes referred to as emergency image formation.

In such a case, in the image forming apparatus 1, subatmospheric pressure is generated in the subtank 35 using the subatmospheric pressure generating unit 93. While subatmospheric pressure is generated in the subtank 35, ink droplets are fired from the print heads 34. In this manner, the image forming apparatus 1 performs image formation by firing ink droplets using only the ink in the subtank 35.

Figure 9:
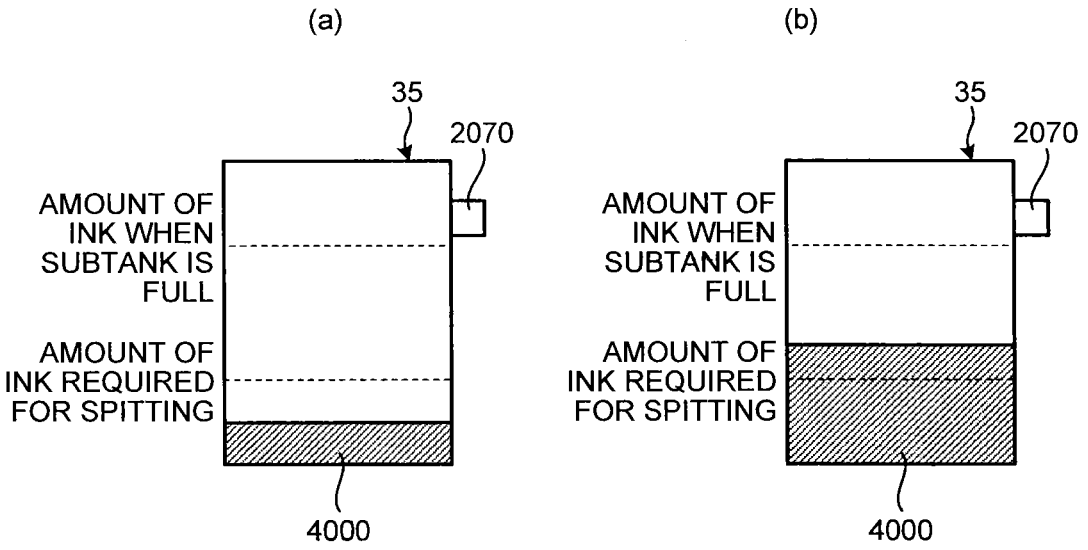
FIG. 9 illustrates the subtank in a different condition.

At this time, if spitting is to be performed to generate subatmospheric pressure in the subtank 35, some amount of ink needs to remain in the subtank 35. FIG. 9 illustrates the subtank 35.

The image forming apparatus 1 may finish the emergency image formation when the remaining amount of ink 4000 in the subtank 35 is less than the minimum amount required for spitting (amount required for spitting), as illustrated in (a) of FIG. 9. The image forming apparatus 1 may perform emergency image formation when the amount of the ink 4000 remaining in the subtank 35 is higher than the amount required for spitting, as illustrated in (b) of FIG. 9.

The amount of ink remaining in the subtank 35 can be detected using the second detecting unit 3010.

Figure 10:
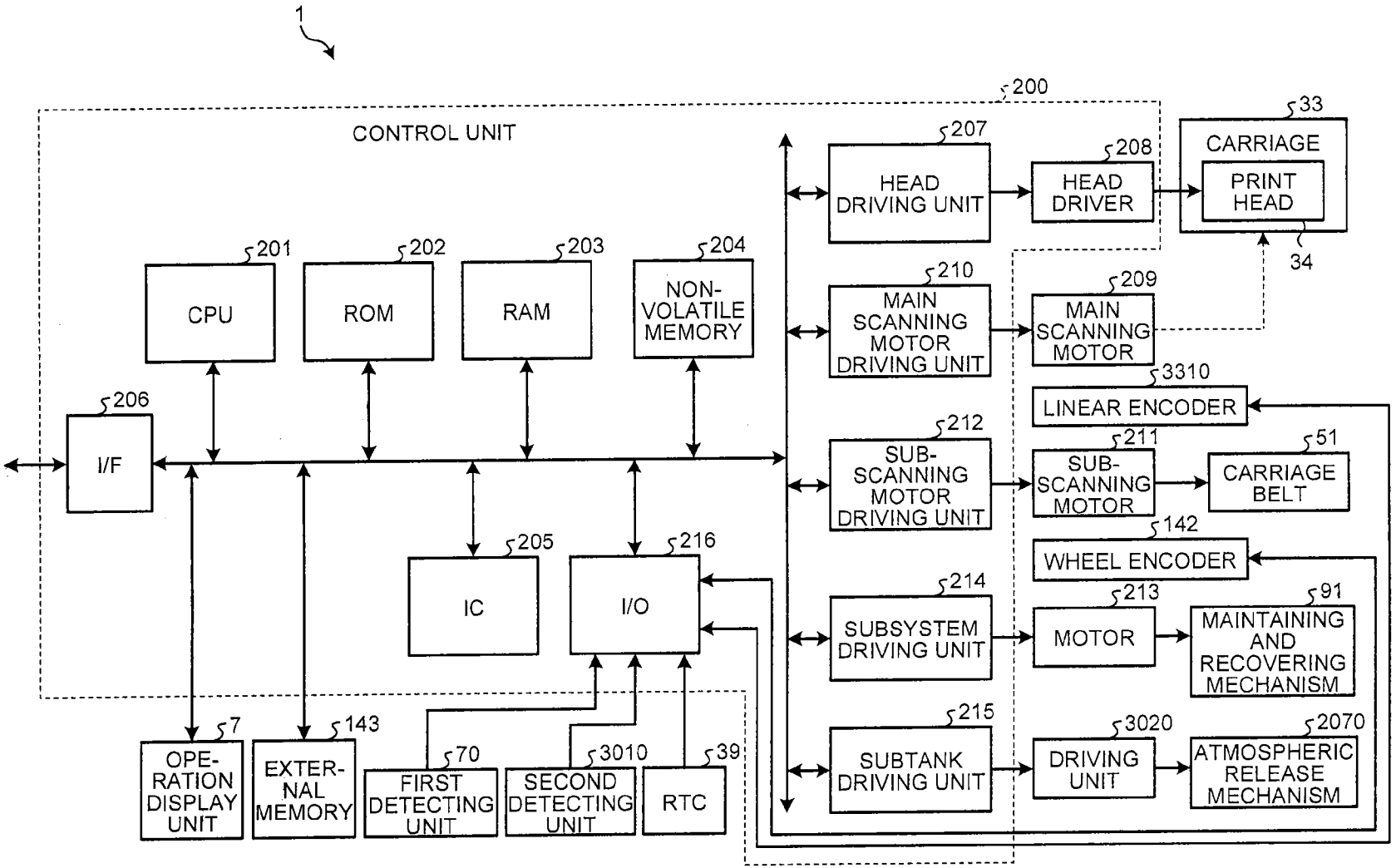
FIG. 10 is a schematic illustrating an electrical configuration of the image forming apparatus according to the embodiment.

An electrical configuration of the image forming apparatus 1 according to the embodiment will now be explained. FIG. 10 is a schematic illustrating an electrical configuration of the image forming apparatus 1 according to the embodiment.

As illustrated in FIG. 10, the image forming apparatus 1 according to the embodiment includes a control unit 200. The control unit 200 controls the entire image forming apparatus 1. The control unit 200 is electrically connected to each device provided to the image forming apparatus 1, such as the operation display unit 7, an external memory 143, the first detecting unit 70, the second detecting unit 3010, a real-time clock (RTC) 39, the carriage 33, the print heads 34, a main scanning motor 209, the linear encoder 3310, a sub-scanning motor 211, a wheel encoder 142, a motor 213, and the driving unit 3020.

The external memory 143 is a storage storing therein various types of data. Examples of the external memory 143 include a known storage medium or a hard disk (HD). The RTC 39 is a device from which time is acquired. The main scanning motor 209 is a driving unit for driving the carriage 33 in the main-scanning direction. The sub-scanning motor 211 is a driving unit that drives the counter roller 57 supporting the carriage belt 51 from the inner side of the carriage belt 51. By causing the sub-scanning motor 211 to drive the counter roller 57, the carriage belt 51 is caused to carry the sheet 42 in the sub-scanning direction.

The wheel encoder 142 detects a position or the like where the sheet 42 is conveyed. The motor 213 is a driving unit that drives each of the units included in the maintaining and recovering mechanism 91.

The control unit 200 includes a central processing unit (CPU) 201, a read only memory (ROM) 202, a random access memory (RAM) 203, a non-volatile memory 204, and an integrated circuit (IC) 205. The ROM 203 stores therein computer programs executed by the CPU 201, and other fixed data. The RAM 203 temporarily stores therein image data and the like. The non-volatile memory 204 retains data while the power of the image forming apparatus 1 is off. The IC 205 performs various signal processing and image processing such as reorganizing to image data, and other input and output signal processing for controlling the entire apparatus.

The control unit 200 also includes an interface (I/F) 206, a head driving unit 207 and a head driver 208, a main scanning motor driving unit 210, a sub-scanning motor driving unit 212, a subsystem driving unit 214, a subtank driving unit 215, and an input-and-output (I/O) unit 216.

The I/F 206 transmits and receives image data to and from an external apparatus. An external apparatus transmits image data representing an image to be formed by the image forming apparatus 1 to the image forming apparatus 1. Examples of the external apparatus include an information processing device such as a personal computer, an image reading device such as an image scanner, and an image capturing device such as a digital camera. The external apparatus is connected to the image forming apparatus 1 over a communication circuit such as the Internet, or over a cable, for example.

The head driving unit 207 and the head driver 208 control driving of the print heads 34. The main scanning motor driving unit 210 controls the position and the movement of the carriage 33 in the main-scanning direction by driving the main scanning motor 209. The sub-scanning motor driving unit 212 drives the sub-scanning motor 211 to control driving of the carriage belt 51. The subsystem driving unit 214 drives the motor 213 for operating the suction pump for suctioning ink from the cap member 92 in the maintaining and recovering mechanism 91. The driving unit 3020 drives the atmospheric release mechanism 2070 that releases the air inside of the subtank 35 to the atmosphere. The I/O unit 216 receives detection signals from the first detecting unit 70, the second detecting unit 3010, the RTC 39, the linear encoder 3310, and the wheel encoder 142.

The CPU 201 in the image forming apparatus 1 reads and analyzes the image data of an image to be formed stored in a receiving buffer included in the I/F unit 206, and applies image processing, data reorganizing process, and the like required in the IC 205 to the image data, and transfers the image data to the head driving unit 207.

Dot pattern data for outputting an image may be generated by storing font data in the ROM 202, or allowing a printer driver on a host to expand the image data to bitmap data and to transfer the bitmap data to the image forming apparatus 1, for example.

When image data (dot pattern data) corresponding to a single scan of the print head 34 is received, the head driving unit 207 synchronizes dot pattern data worth of the single scan to the clock signal, and transmits the data to the head driver 208 as serial data, or transmits a latch signal to the head driver 208 at a predetermined timing.

The head driving unit 207 includes a driving waveform generating circuit having a ROM storing therein pattern data of driving signals, a waveform generation circuit having a digital-to-analog (D/A) converter that D/A converts the driving waveform data read from the ROM, and an amplifier.

The head driver 208 includes a shift register that is input with the clock signal from the head driving unit 207 and the serial data being image data, a latch circuit that latches registered values in the shift register by a latch signal from the head driving unit 207, a level conversion circuit (level shifter) that changes the level of an output from the latch circuit, and an array of analog switches having ON/OFF controlled by the level shifter. By controlling ON/OFF of the analog switch array, the head driver 208 selectively applies a required driving waveform included in a driving signal to the print head 34 to drive the head. In this manner, a voltage corresponding to each dot in the image data is applied to the print head 34, and ink droplets in an amount corresponding to the voltage thus applied is fired from the print head 34.

Figure 11:
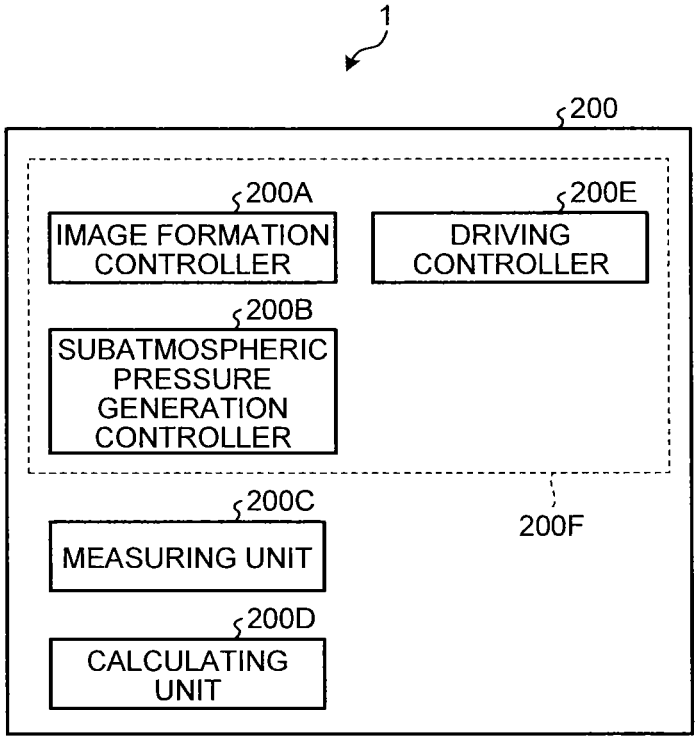
FIG. 11 is a block diagram illustrating a functional configuration of a control unit included in the image forming apparatus.

A functional configuration of the image forming apparatus 1 will now be explained. FIG. 11 is a block diagram illustrating a functional configuration of the control unit 200 in the image forming apparatus 1.

As illustrated in FIG. 11, the control unit 200 in the image forming apparatus 1 includes a controller 200F, a measuring unit 200C, and a calculating unit 200D. The controller 200F includes an image formation controller 200A, a subatmospheric pressure generation controller 200B, and a driving controller 200E.

The image formation controller 200A controls the amount of ink droplets fired from the print heads 34, the moving velocity of the print heads 34 in the main-scanning direction and in the sub-scanning direction with respect to the sheet 42, for example. The image formation controller 200A performs such control by controlling the head driving unit 207, the main scanning motor driving unit 210, the sub-scanning motor driving unit 212, the subsystem driving unit 214, and the like illustrated in FIG. 10.

The subatmospheric pressure generation controller 200B controls generation of the subatmospheric pressure in the subtank 35. The subatmospheric pressure generation controller 200B controls generation of the subatmospheric pressure in the subtank 35 by controlling the subatmospheric pressure generating unit 93.

The measuring unit 200C measures time elapsed from when subatmospheric pressure is generated inside of the subtank 35 for the first time after the amount of ink remaining in the ink cartridge 10 is detected to be lower than the first threshold. The calculating unit 200D calculates a time elapsed from when subatmospheric pressure is generated inside of the subtank 35 for the first time after the amount of ink remaining in the ink cartridge 10 is detected to be lower than the first threshold to when the subatmospheric pressure in the subtank 35 is generated next time while the amount of ink remaining in the ink cartridge 10 is still lower than the first threshold.

When the time elapsed from when subatmospheric pressure is generated inside of the subtank 35 for the first time after the amount of ink remaining in the ink cartridge 10 is detected to be lower than the first threshold to when the subatmospheric pressure in the subtank 35 is generated next time while the amount of ink remaining in the ink cartridge 10 is still lower than the first threshold exceeds a predetermined second threshold, the controller 200F controls the print heads 34 (in other words, the driving controller 200E) to stop firing ink droplets from the print heads 34.

The second threshold is determined as a time less than a time from when subatmospheric pressure is generated inside of the subtank 35 and ink droplets are started to be fired using ink in the subtank 35, while the amount of ink remaining in the ink cartridge 10 is less than the first threshold (in other words, while no ink is supplied from the ink cartridge 10 to the subtank 35) to when the ink starts clogging the nozzles on the print heads 34. The second threshold may be determined in advance in a manner suitable for a configuration of the image forming apparatus 1, the ink used, and the like, and stored in the external memory 143, the non-volatile memory 204, or the like.

Similarly, the first threshold may be determined in advance, and stored in the external memory 143, the non-volatile memory 204, or the like.

The first threshold or the second threshold may be modified by an operation instruction or the like performed by a user on the operation display unit 7.

An image forming process performed by the image forming apparatus 1 will now be explained.

Figure 12:
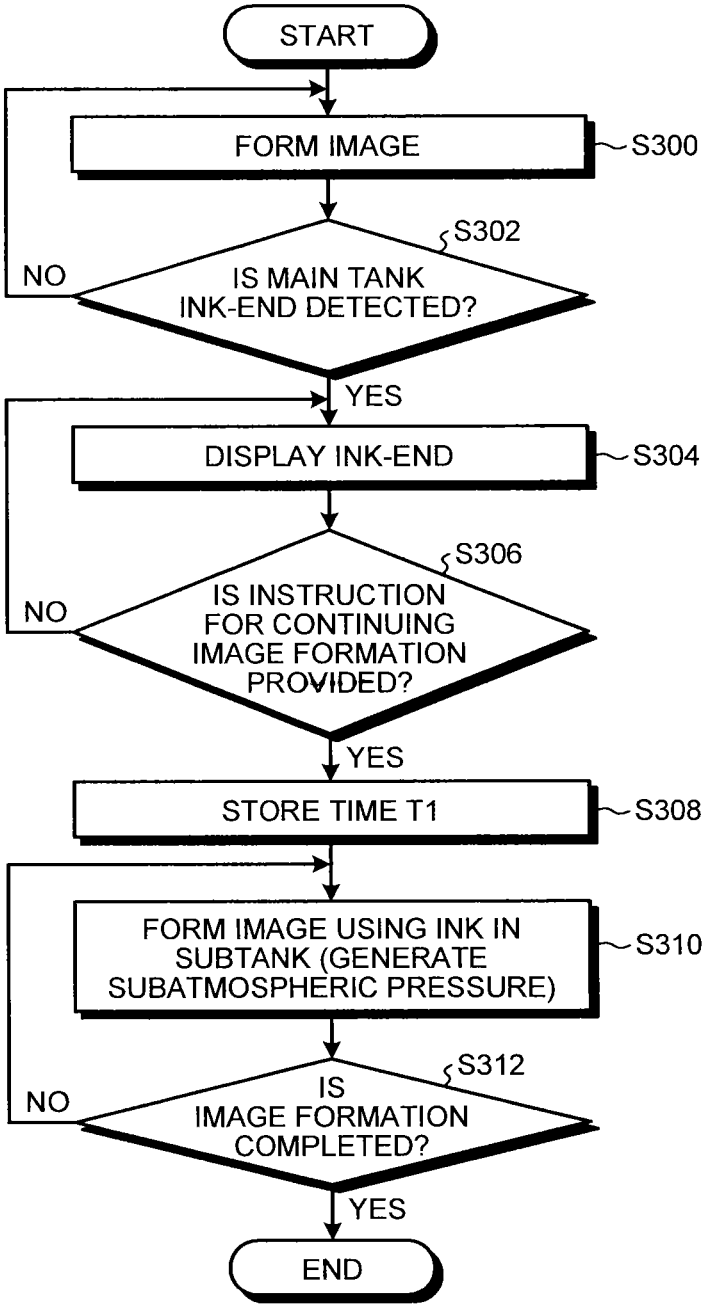
FIG. 12 is a flowchart illustrating an image forming process.

FIG. 12 is a flowchart illustrating an image forming process performed by the image forming apparatus 1 according to the embodiment.

To begin with, the image formation controller 200A starts image formation (Step S300). At Step S300, the image formation controller 200A performs normal image formation.

During the normal image formation, an ink supplying mechanism supplies ink from the ink cartridge 10 to the subtank 35. The ink thus supplied is stored in the subtank 35, and supplied to the print head 34 as required. The normal image formation means an image forming operation in which image formation is performed by supplying ink from the ink cartridge 10 to the print head 34 via the subtank 35 as an image is formed (as ink droplets are fired from the print head 34), while the amount of ink remaining in the ink cartridge 10 is equal to or more than the first threshold.

The controller 200F then determines if an ink-end of the main tank is detected (Step S302). At Step S302, the controller 200F makes the determination at Step S302 by determining if an ink-end of the ink cartridge 10 is detected by the first detecting unit 70 (may be detected by the second detecting unit 3010). If the controller 200F determines No at Step S302 (No at Step S302), the system control returns to Step S300, and the normal image formation is continued.

If the controller 200F determines Yes at Step S302 (Yes at Step S302), the system control goes to Step S304. At Step S304, the controller 200F causes the operation display unit 7 to display "ink-end" indicating the amount of ink remaining in the ink cartridge 10 is short (Step S304). More specifically, the controller 200F displays an ink-end on the remaining ink indicator 11 (for example, the remaining ink indicator 11C) corresponding to the color of the ink stored in the ink cartridge 10 from which an ink-end is detected at Step S302 (for example, the ink cartridge 10C).

The controller 200F then determines if an instruction for continuing image formation is received (Step S306). The determination at Step S306 is made by determining if a signal indicating to continue image formation is received from the operation display unit 7 based on a user operation instruction given on the continue image formation button 13.

If the controller 200F determines No at Step S306 (No at Step S306), the system control returns to Step S304. If the controller 200F determines Yes at Step S306 (Yes at Step S306), the system control goes to Step S308.

At Step S308, the controller 200F stores a time T1 that is the time at which the instruction for continuing image formation is given at Step S306 in the non-volatile memory 204 or the like. More specifically, at Step S308, the controller 200F reads the time at which the controller 200F determines Yes at Step S306 from the RTC 39, and stores the time in the non-volatile memory 204 as the time T1.

In other words, the time T1 indicates time at which the emergency image formation, which is to be described later, is started at Step S310. In other words, the time T1 corresponds to the time at which generation of the subatmospheric pressure in the subtank 35 is started while the amount of ink remaining in the ink cartridge 10 is less than the first threshold, through the process at Step S310 which is to be described later.

The controller 200F then performs the emergency image formation being image formation using only the ink in the subtank 35 (Step S310).

The emergency image formation is an image formation operation in which an image is formed, despite the ink cartridge 10 has reached an ink-end (the amount of remaining ink is less than the first threshold), by firing ink droplets using the ink remaining in the subtank 35. In other words, during the emergency image formation, ink is supplied to the print head 34 by generating subatmospheric pressure in the subtank 35. In this manner, the print head 34 fires ink droplets using the ink remaining in the subtank 35.

More specifically, at Step S310, the controller 200F opens the valve 2070*b* provided to the atmospheric release mechanism 2070 provided to the subtank 35 to release the air inside of the subtank 35 to the atmosphere. After bringing the pressure in the subtank 35 to a level that is approximately the same as the atmosphere by introducing the atmosphere into the subtank 35, the valve 2070*b* is closed. Ink droplets not contributing to image formation are then fired from the print head 34 (so-called spitting is performed) to reduce the pressure in the subtank 35 to generate subatmospheric pressure inside of the subtank 35 (in other words, to bring the pressure inside of the subtank 35 to a subatmospheric level). Alternatively, the maintaining and recovering mechanism 91 may be used to generate subatmospheric pressure inside of the subtank 35.

After the subatmospheric pressure is generated inside of the subtank 35, the print head 34 is driven so that the print head 34 fires ink droplets contributing to image formation. Such control is performed by the controller 200F.

In other words, through the process at Step S310, subatmospheric pressure is generated inside of the subtank 35, and image formation using only the ink in the subtank 35 (ink droplet fired from the print heads 34) is started.

The controller 200F then determines if the image formation is completed (Step S312). The determination at Step S312 is made by determining firing of all of ink droplets corresponding to the image data of the image to be formed is completed If the controller 200F determines No at Step S312 (No at Step S312), the system control returns to Step S310. If the controller 200F determines Yes at Step S312 (Yes at Step S312), this routine is ended. The process of generating subatmospheric pressure inside of the subtank 35 at Step S310 is performed only once when an instruction for continuing image formation is provided, and only firing of the ink droplets from the print heads 34 is continued subsequently. Therefore, when the controller 200F determines No at Step S312 and the system control returns to Step S310, only firing of the ink droplets from the print heads 34 is performed, without generating subatmospheric pressure inside of the subtank 35, unless an instruction for continuing image formation is provided again.

Through the processes at Step S300 to Step S312, if a user gives an instruction to continue image formation after the ink cartridge 10 reaches an ink-end state, the image forming apparatus 1 can continue image formation using the ink in the subtank 35.

Figure 13:
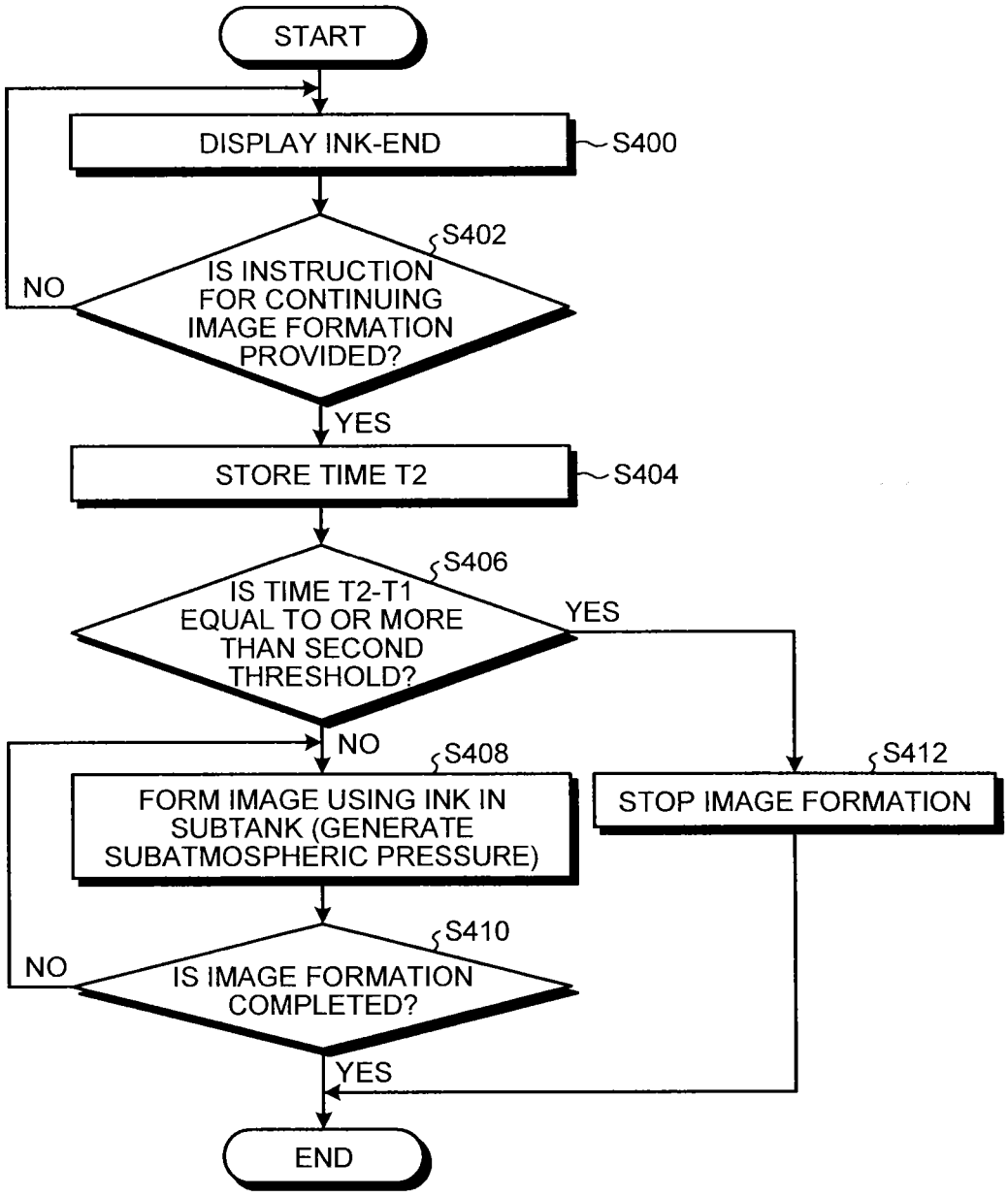
FIG. 13 is a flowchart illustrating the image forming process.

At this time, the image forming apparatus 1 according to the embodiment further performs the image forming process illustrated in FIG. 13. FIG. 13 is a flowchart illustrating an image forming process performed when an ink-end is displayed on the image forming apparatus 1 according to the embodiment. The controller 200F continues displaying an ink-end only when the amount of ink remaining in the ink cartridge 10 is less than the first threshold.

In other words, the image forming process illustrated in FIG. 13 is a process performed when the controller 200F determines No at Step S312 in FIG. 12 (No at Step S312). Therefore, an ink-end is kept displayed on the operation display unit 7 of the image forming apparatus 1 (in other words, the amount of ink remaining in the ink cartridge 10 is still less than the first threshold) (Step S400).

At Step S402, the controller 200F determines if an instruction indicating to continue image formation is provided again while the amount of ink remaining in the ink cartridge 10 is less than the first threshold (Step S402). The determination at Step S402 is made by determining if a user gives an operation instruction on the continue image formation button 13 again and a signal indicating to continue image formation is received from the operation display unit 7 after the emergency image formation using only the ink in the subtank 35 is started while the amount of ink remaining in the ink cartridge 10 is less than the first threshold (while Yes at Step S302).

As mentioned earlier, because generation of subatmospheric pressure in the subtank 35 is performed when an instruction for continuing image formation is provided, the determination at Step S402 is equivalent to determining if an instruction for generating subatmospheric pressure in the subtank 35 is provided again.

If the controller 200F determines No at Step S402 (No at Step S402), the system control returns to Step S400. If the controller 200F determines Yes at Step S402 (Yes at Step S402), the system control goes to Step S404.

At Step S404, the controller 200F stores a time T2 being the time at which an instruction for continuing image formation is provided at Step S402 in the non-volatile memory 204 or the like. More specifically, at Step S402, the controller 200F reads the time at which the controller 200F determines Yes at Step S402 from the RTC 39, and stores the time in the non-volatile memory 204 as the time T2.

The calculating unit 200D then calculates a difference between the time T1 at which an instruction for continuing image formation is provided previously at Step S306 (in other words, the time at which subatmospheric pressure is generated inside of the subtank 35) and the time T2 at which an instruction for continuing image formation is provided again at Step S402 (in other words, the time at which subatmospheric pressure is generated again in the subtank 35). The controller 200F then determines if the difference thus calculated (T2−T1) is equal to or more than the second threshold (Step S406).

The difference between the time T1 and the time T2 represents a time elapsed after the emergency image formation is started. To explain differently, the difference between the time T1 and the time T2 represents a time elapsed from when subatmospheric pressure is generated inside of the subtank 35 for the first time after the amount of ink remaining in the ink cartridge 10 is detected to be lower than the first threshold. More specifically, the difference between the time T1 and the time T2 represents a time elapsed from when subatmospheric pressure is generated inside of the subtank 35 for the first time after the amount of ink remaining in the ink cartridge 10 is detected to be lower than the first threshold to when subatmospheric pressure is generated again in the subtank 35 while the amount of ink remaining in the ink cartridge 10 is still lower than the first threshold.

If the controller 200F determines Yes at Step S406 (Yes at Step S406), in other words, if the time elapsed after the emergency image formation is started is equal to or more than the second threshold, the image formation is stopped (firing of ink droplets is stopped) (Step S412), and this routine is ended. At Step S412, the image formation itself may be stopped.

If the controller 200F determines No at Step S406 (No at Step S406), in other words, the time elapsed after the emergency image formation is started is less than the second threshold, the system control goes to Step S408.

At Step S408, subatmospheric pressure is generated inside of the subtank 35 in the same manner as at Step S310, and the emergency image formation that is image formation using only the ink in the subtank 35 is performed (Step S408).

The controller 200F then determines if the image formation is completed (Step S410). The determination at Step S410 is made by determining if the firing of ink droplets based on the image data of the image to be formed is completed.

If the controller 200F determines No at Step S410 (No at Step S410), the system control returns to Step S408. If the controller 200F determines Yes at Step S410 (Yes at Step S410), this routine is ended. At Step S408, the process of generating subatmospheric pressure in the subtank 35 is performed once when an instruction for continuing image formation is given, and only firing of ink droplets from the print heads 34 is continued, in the same manner as at Step S310. Therefore, when the controller 200F determines No at Step S410 and returned to Step S408, only firing of ink droplets from the print heads 34 is continued without generating subatmospheric pressure in the subtank 35 again unless an instruction for continuing image formation is given again.

As explained above, in the image forming apparatus 1 according to the embodiment, if the time elapsed from when subatmospheric pressure is generated inside of the subtank 35 for the first time after the amount of ink remaining in the ink cartridge 10 is detected to be lower than the first threshold is less than the first threshold, emergency image formation in which subatmospheric pressure is generated inside of the subtank 35 and images are formed using only the ink in the subtank 35 is performed. By contrast, in the image forming apparatus 1 according to the embodiment, if the time elapsed is equal to or longer than the first threshold, the emergency image formation in which images are formed using only the ink in the subtank 35 is stopped (or ended).

In this manner, in the image forming apparatus 1 according to the embodiment, if the time elapsed from when subatmospheric pressure is generated inside of the subtank 35 for the first time after the amount of ink remaining in the ink cartridge 10 is detected to be lower than the first threshold is less than the first threshold, the emergency image formation in which subatmospheric pressure is generated inside of the subtank 35 and images are formed using only the ink in the subtank 35 is continued. Therefore, the image forming apparatus 1 can be prevented from forming images for a long time (time equal to or longer than the first threshold) while the ink cartridge 10 is at ink-end state.

Therefore, in the image forming apparatus 1 according to the embodiment, the ink cartridge 10 can be prevented from being kept with a low amount of remaining ink for a long time, and the ink can be suppressed from clogging the nozzles that are outlets from which ink droplets are fired, for example. Therefore, image quality deterioration caused by clogging ink can be suppressed.

Furthermore, as mentioned earlier, the first threshold and the second threshold can be modified by a user giving an operation instruction on the operation display unit 7. Therefore, appropriate thresholds can be specified as the first threshold and the second threshold depending on the type of ink used, and a user environment such as time required for a user to procure a replacement for the ink cartridge 10, for example.

Furthermore, as mentioned earlier, the image forming apparatus 1 according to the present embodiment can continue image formation using the ink remaining in the subtank 35 when a user gives an instruction for continuing image formation even when the ink cartridge 10 reaches ink-end state.

Modification 1

When the difference between the time T2 and the time T1 is less than the second threshold, the remaining time for which the emergency image formation can be continued may be displayed on the operation display unit 7. Furthermore, when the difference between the time T2 and the time T1 becomes equal to or more than the second threshold, information indicating that the threshold is exceeded may be displayed on the operation display unit 7.

Figure 14:
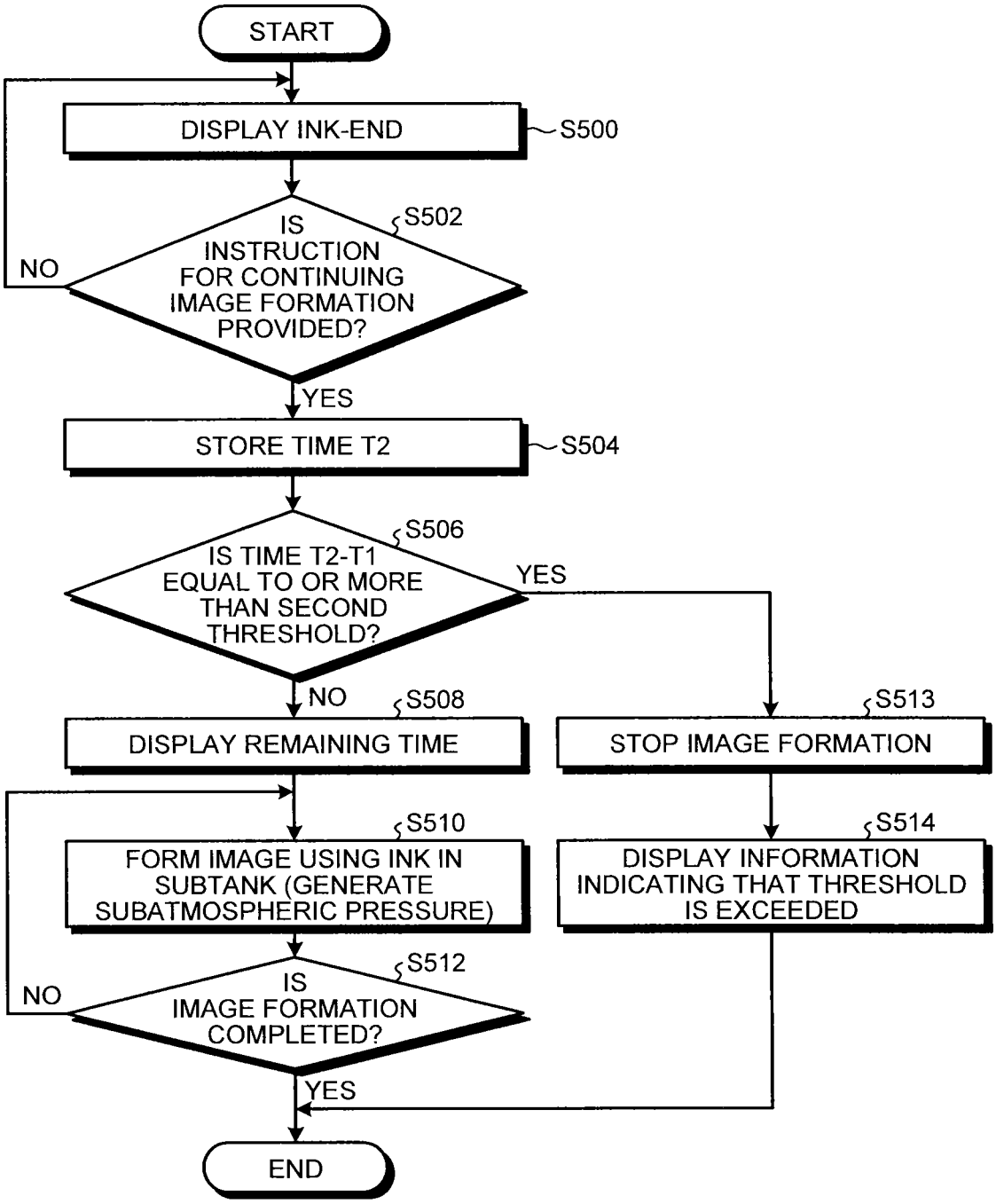
FIG. 14 is a flowchart illustrating another image forming process (Modification 1)

In such a case, the routine illustrated in FIG. 14 can be performed instead of the routine of the image forming process of illustrated in FIG. 13. FIG. 14 is a flowchart illustrating an image forming process performed when an ink-end is displayed on the image forming apparatus 1 according to Modification 1. The image forming process illustrated in FIG. 14 is another process performed when the controller 200F determines No at Step S312 in FIG. 12 (No at Step S312). Therefore, an ink-end is displayed on the operation display unit 7 in the image forming apparatus 1 (in other words, the amount of ink remaining in the ink cartridge 10 is less than the first threshold) (Step S500).

The controller 200F then performs the processes at Step S502 to Step S506, in the same manner as Step S402 to Step S406. At Step S506, the calculating unit 200D calculates the difference between the time T1 at which an instruction for continuing image formation is given previously (in other words, the time at which subatmospheric pressure is generated previously in the subtank 35) at Step S308 and the time T2 at which an instruction for continuing image formation is provided again (in other words, the time at which subatmospheric pressure is generated inside of the subtank 35 again) at Step S502, in the same manner as Step S406. The controller 200F then determines if the difference thus calculated (T2−T1) is equal to or more than the second threshold (Step S506).

If the controller 200F determines Yes at Step S506 (Yes at Step S506), the system control goes to Step S513, and the controller 200F stops the emergency image formation (Step S513). The controller 200F then displays the information indicating that the threshold is exceeded on the operation display unit 7 (Step S514), and this routine is ended.

Figure 15:
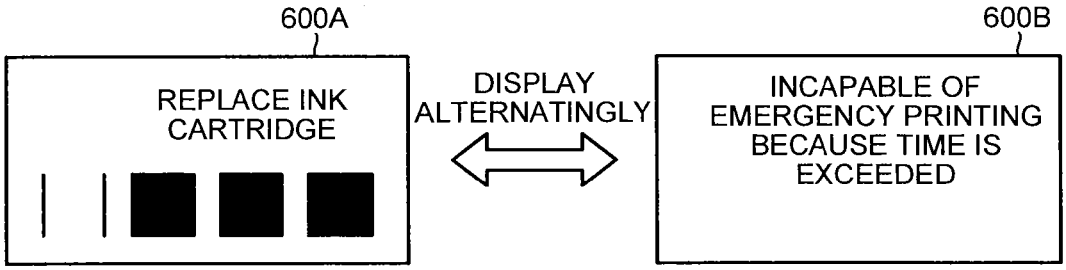
FIG. 15 is a schematic illustrating an example of a display screen.

FIG. 15 is a schematic illustrating an example of a display screen displayed on the operation display unit 7 through the process at Step S514. As illustrated in FIG. 15, through the process at Step S514, a display screen 600A indicating that the amount of remaining ink in the ink cartridge 10 for the corresponding color is less than the first threshold and a display screen 600B including character information such as "incapable of emergency printing because time is exceeded" as information indicating that the threshold is exceeded are displayed alternatingly on the operation display unit 7, for example.

Referring back to FIG. 14, if the controller 200F determines No at Step S506 (No at Step S506), the system control goes to Step S508, and the time for which the emergency image formation can be continued is displayed on the operation display unit 7 (Step S508). The processes at Step S510 and Step S512 are then performed in the same manner as Step S408 and Step S410, and this routine is ended.

Figure 16:
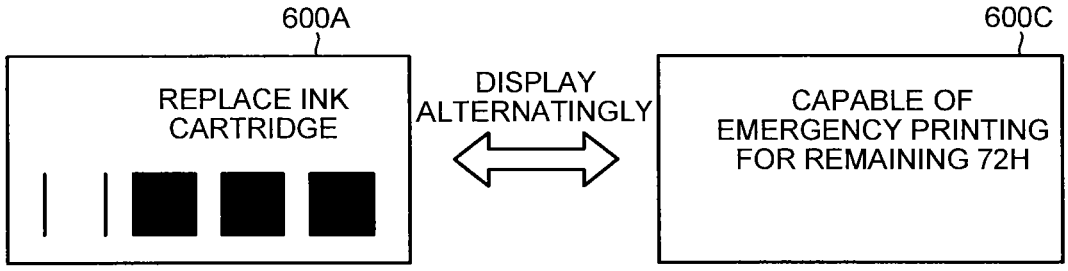
FIG. 16 is a schematic illustrating another example of a display screen.

FIG. 16 is a schematic illustrating an example of a display screen displayed on the operation display unit 7 through the process at Step S508. As illustrated in FIG. 16, through the process at Step S508, the display screen 600A indicating that the amount of remaining ink in the ink cartridge 10 for the each of the colors is less than the first threshold and a display screen 600C including character information such as "capable of emergency printing for remaining 72 h" as information indicating the remaining time for which the emergency image formation can be continued (e.g. 72 hours) are displayed alternatingly on the operation display unit 7.

Figure 17:
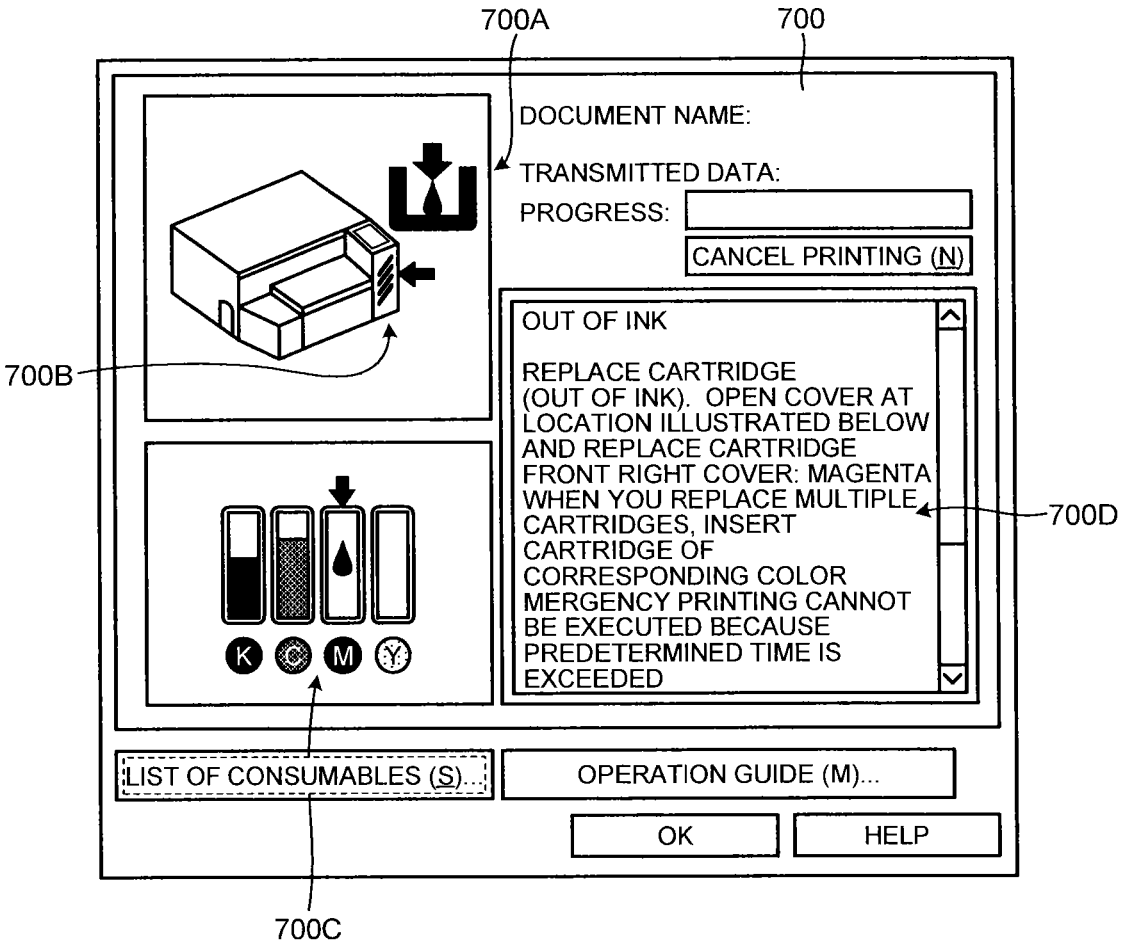
FIG. 17 is a schematic illustrating still another example of the display screen.

FIG. 17 is a schematic illustrating another example of a display screen displayed on the operation display unit 7 through the process at Step S514. Through the process at Step S514, the controller 200F may also display a display screen 700 illustrated in FIG. 17 on the operation display unit 7. In FIG. 17, the display screen 700 includes images (an image 700B, an image 700A, and an image 700C) indicating that a small amount of ink is remaining in the ink cartridge 10, and an image 700D including character information indicating that the emergency printing (emergency image formation) cannot be continued because the time elapsed is exceeded a predetermined time (is equal to or more than the second threshold).

Figure 18:
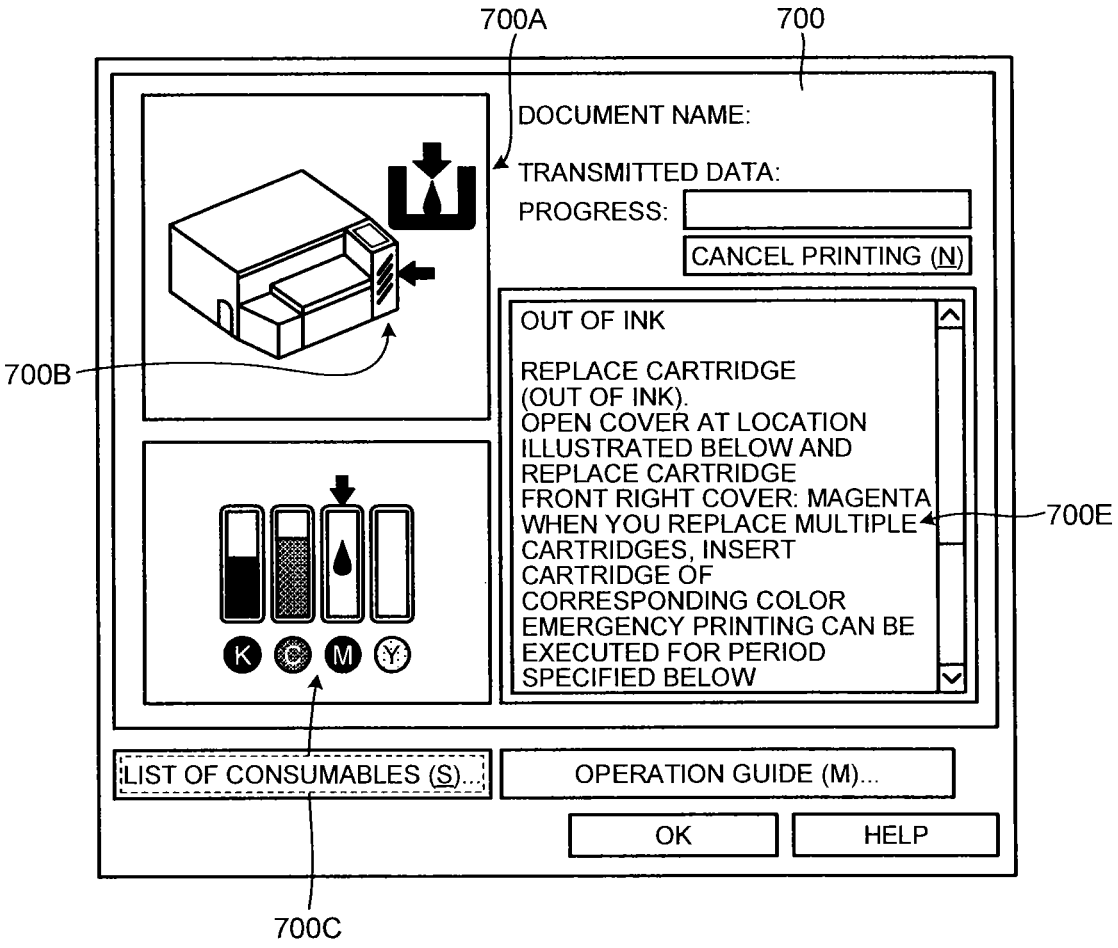
FIG. 18 is a schematic illustrating still another example of the display screen.

FIG. 18 is a schematic illustrating another example of a display screen displayed on the operation display unit 7 through the process at Step S508. Through the process at Step S508, the controller 200F may also display the display screen 700 illustrated in FIG. 18 on the operation display unit 7. In FIG. 18, the display screen 700 includes the images (the image 700B, the image 700A, and the image 700C) indicating that a small amount of ink is remaining in the ink cartridge 10, and an image 700E including character information indicating the remaining time for which the emergency image formation (emergency printing) can be continued.

In this manner, when the difference between the time T2 and the time T1 is less than the second threshold, the remaining time for which the emergency image formation can be continued may be displayed on the operation display unit 7. When the difference between the time T2 and the time T1 is equal to or more than the second threshold, information indicating that the threshold is exceeded may be displayed on the operation display unit 7.

Modification 2

During the emergency image formation, the image forming apparatus 1 may perform image formation with a reduce ink density, by firing smaller amount of ink droplets compared with that during the normal image formation.

Figure 19:
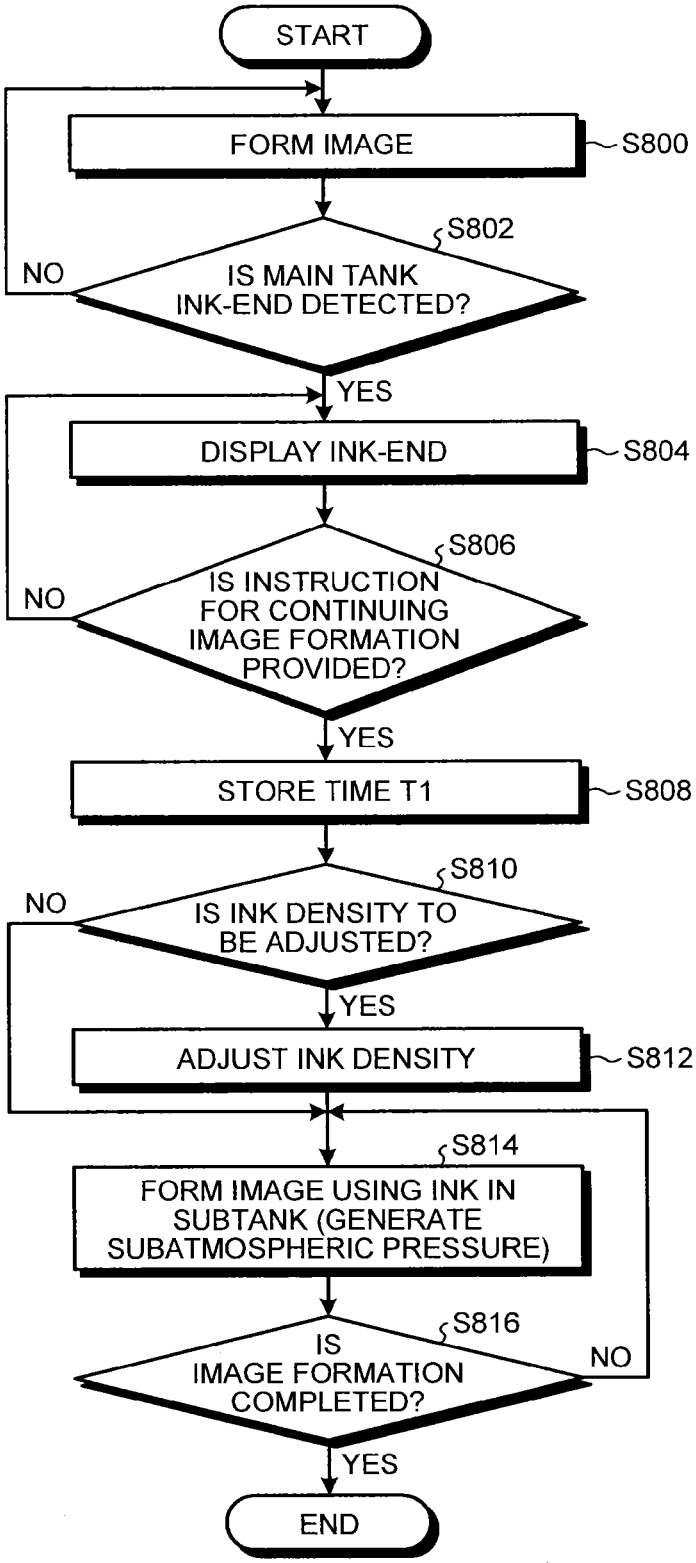
FIG. 19 is a flowchart illustrating an image forming process (Modification 2)
Figure 20:
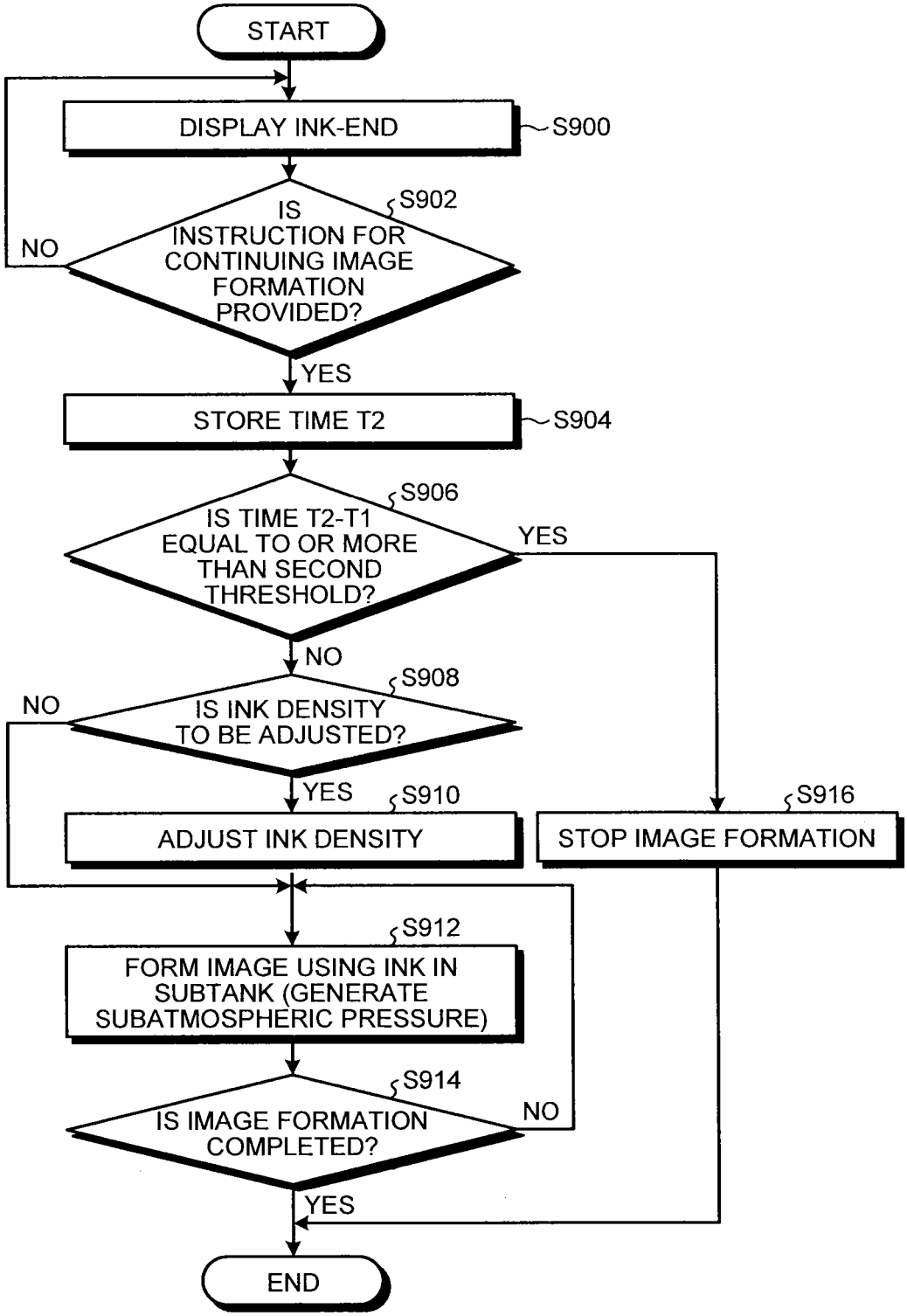
FIG. 20 is a flowchart illustrating the image forming process.

In such a case, the image forming apparatus 1 may execute the image forming process illustrated in FIGS. 19 and 20.

FIG. 19 is a flowchart illustrating an image forming process performed by the image forming apparatus 1 according to a modification 2.

To begin with, the image forming apparatus 1 performs the process at Step S800 to Step S808 and stores the time T1, in the same manner at Step S300 to Step S308 (see FIG. 12).

The controller 200F then determines if an ink density adjustment is to be performed (Step S810). The determination at Step S810 is made by determining if the amount of ink remaining in the subtank 35 is equal to or more than a predetermined third threshold. The third threshold may be an amount by which an image can be formed by firing ink only from the subtank 35. The third threshold may be stored in the non-volatile memory 204, the external memory 143, or the like in advance. The third threshold can be modified by a user making an operation instruction on the operation display unit 7.

If the controller 200F determines Yes at Step S810 (Yes at Step S810), the system control goes to Step S810. At Step S810, the controller 200F adjusts the amount of ink droplets fired to form a dot corresponding to a pixel included in an image to be formed to a smaller amount than that used in the normal image formation. The amount of ink reduced from the amount used in the normal image formation may be set in advance, or may be adjusted as required by a user making an operation instruction on the operation display unit 7. For example, an instruction for adjusting the amount of ink droplets to A percent of that used in normal image formation (where A is a value equal to or more than one and equal to or less than 99) may be received from the operation display unit 7, and stored in the non-volatile memory 204 in advance. The controller 200F (more specifically, the image formation controller 200A) then reads the value (A percent) from the non-volatile memory 204, and when the controller 200F determines Yes at Step S810, the controller 200F adjusts the amount of ink droplets fired to A percent of the amount of ink used in forming a single dot during the normal image formation.

Through the process at Step S812, the density of an image formed during the emergency image formation is reduced from that of an image formed during the normal image formation.

The processes at Step S814 and Step S816 are then performed in the same manner as Step S310 and Step S312 in FIG. 12, and this routine is ended.

FIG. 20 is a flowchart illustrating an image forming process performed when an ink-end is displayed on the image forming apparatus 1 according to Modification 2. In other words, in the image forming apparatus 1 according to Modification 2, the process illustrated in FIG. 20 is performed when the controller 200F determines No at Step S816 in FIG. 19 (No at Step S914).

To begin with, the image forming apparatus 1 performs the processes at Step S900 to Step S904, in the same manner as Step S400 to Step S404 in FIG. 13, and stores the time T2 in the non-volatile memory 204. At Step S906, the calculating unit 200D then calculates the time T1 at which an instruction for continuing image formation is previously provided at Step S806 (in other words, the time at which subatmospheric pressure is generated previously in the subtank 35) and the time T2 at which an instruction for continuing image formation is provided again at Step S902 (in other words, the time at which subatmospheric pressure is generated again in the subtank 35). The controller 200F then determines the difference thus calculated (T2−T1) is equal to or more than the second threshold (Step S906).

The image forming apparatus 1 then performs Step S908 and Step S910, in the same manner as Step S810 and Step S812 (see FIG. 19). If the controller 200F determines that an ink density adjustment is to be performed, the amount of fired ink is adjusted so that an image is formed in a lower density than that achieved in the normal image formation.

The image forming apparatus 1 then performs the processes at Step S912 and Step S914, in the same manner as Step S408 and Step S410 (see FIG. 13), and this routine is ended. If the controller 200F determines No at Step S906 (No at Step S906), the system control goes to Step S916. The controller 200F then stops the emergency image formation (Step S916), and this routine is ended.

As explained above, in the image forming apparatus 1, during the emergency image formation, a smaller amount of ink droplets is fired compared with that during the normal image formation so that emergency image formation is performed with a reduced ink density.

The processes at Step S810 and Step S812 may also be performed during the normal image formation.

The computer program executed on the image forming apparatus 1 according to the embodiment is provided in a manner incorporated in a ROM or the like in advance. The computer program executed on the image forming apparatus 1 according to the embodiment may also be provided in a manner stored in a computer-readable storage medium, such as a compact disk read-only memory (CD-ROM), a flexible disk (FD), a compact disk recordable (CD-R), or a digital versatile disk (DVD), as a file in an installable or executable format.

Furthermore, the computer program executed on the image forming apparatus 1 according to the embodiment may be stored in a computer connected to a network such as the Internet, and made available for download over the network. The computer program executed on the image forming apparatus 1 according to the embodiment may be provided or distributed over a network such as the Internet.

The image forming apparatus 1 according to the embodiment may be any image forming apparatus that forms an image on a sheet 42 by firing ink from the print heads 34 using ink supplied from the ink cartridge 10 to the subtank 35. As the image forming apparatus 1, the present invention is applicable to any multifunctional peripheral (MFP) having at least two of a copier function, a printer function, a scanner function, and a facsimile function, and any printer, scanner, facsimile, and the like.

According to the embodiments, it is possible to provide the advantage of suppressing deterioration of the image quality caused by clogging ink even when the amount of ink remaining in the ink cartridge is low.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:
- a print head configured to fire ink droplets;
- a subtank configured to store therein ink and supply the ink to the print head;
- a subatmospheric pressure generating unit configured to generate subatmospheric pressure in the subtank;
- a main tank configured to supply ink to the subtank;
- a detecting unit configured to detect an amount of ink in the main tank; and
- a control unit configured to
  - control the subatmospheric pressure generating unit to generate subatmospheric pressure in the subtank and control the print head to fire ink droplets when the detecting unit detects that an amount of ink in the main tank is less than a predetermined first threshold, and
  - control the print head to stop firing ink droplets when a time elapsed after the subatmospheric pressure is generated in the subtank exceeds a predetermined second threshold.

2. The image forming apparatus according to claim 1, wherein, when the detecting unit detects that an amount of ink in the main tank is less than the first threshold, the control unit controls the subatmospheric pressure generating unit to generate subatmospheric pressure in the subtank and controls the print head to fire an amount of ink droplets smaller than an amount of ink droplets fired before the detecting unit detects that an amount of ink in the main tank is less than the first threshold.

3. The image forming apparatus according to claim 1, wherein, when a time elapsed after the subatmospheric pressure is generated in the subtank is equal to or less than the second threshold, the control unit controls a display unit to display a difference between the time elapsed and the second threshold.

4. The image forming apparatus according to claim 1, further comprising an operating unit configured to receive the first threshold from a user, wherein
- when the detecting unit detects that an amount of ink in the main tank is less than the first threshold received, the control unit controls the subatmospheric pressure generating unit to generate subatmospheric pressure in the subtank and controls the print head to fire ink droplets.

5. An image forming method performed in an image forming apparatus that includes a print head configured to fire ink droplets, a subtank configured to store therein ink and supply the ink to the print head, a subatmospheric pressure generating unit configured to generate subatmospheric pressure in the subtank, and a main tank configured to supply ink to the subtank, the image forming method comprising:
- detecting an amount of ink in the main tank;
- controlling the subatmospheric pressure generating unit to generate subatmospheric pressure in the subtank and to cause the print head to fire ink droplets when an amount of ink in the main tank is detected to be less than a predetermined first threshold; and
- controlling the print head to stop firing ink droplets when a time elapsed after the subatmospheric pressure is generated in the subtank exceeds a predetermined second threshold.

6. A non-transitory computer-readable storage medium with an executable program stored thereon and executed by a processor of an image forming apparatus that includes a print head configured to fire ink droplets, a subtank configured to store therein ink and supply the ink to the print head, a subatmospheric pressure generating unit configured to generate subatmospheric pressure in the subtank, and a main tank configured to supply ink to the subtank, wherein the program instructs the processor to perform:

detecting an amount of ink in the main tank;

controlling the subatmospheric pressure generating unit to generate subatmospheric pressure in the subtank and to cause the print head to fire ink droplets when an amount of ink in the main tank is detected to be less than a predetermined first threshold; and controlling the print head to stop firing ink droplets when a time elapsed after the subatmospheric pressure is generated in the subtank exceeds a predetermined second threshold.

* * * * *